US011587713B2

(12) United States Patent
Tanaka

(10) Patent No.: US 11,587,713 B2
(45) Date of Patent: Feb. 21, 2023

(54) INDUCTOR COMPONENT

(71) Applicant: Murata Manufacturing Co., Ltd., Kyoto-fu (JP)

(72) Inventor: Akira Tanaka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 596 days.

(21) Appl. No.: 16/243,982

(22) Filed: Jan. 9, 2019

(65) Prior Publication Data

US 2019/0237233 A1 Aug. 1, 2019

(30) Foreign Application Priority Data

Jan. 30, 2018 (JP) ..... JP2018-014046

(51) Int. Cl.

| | |
|---|---|
| ***H01F 27/29*** | (2006.01) |
| ***H01F 27/02*** | (2006.01) |
| ***H01F 27/24*** | (2006.01) |
| ***H01F 41/10*** | (2006.01) |
| ***H01F 27/28*** | (2006.01) |
| ***H01F 17/04*** | (2006.01) |

(52) U.S. Cl.

CPC ..... *H01F 27/022* (2013.01); *H01F 17/045* (2013.01); *H01F 27/24* (2013.01); *H01F 27/2828* (2013.01); *H01F 27/292* (2013.01); *H01F 41/10* (2013.01)

(58) Field of Classification Search

CPC ..... H01F 27/022; H01F 17/045; H01F 27/24; H01F 41/10; H01F 27/2828; H01F 27/292; H01F 2017/048; H01F 27/2804; H01F 2027/2809; H01F 17/0013; H01F 17/0006

See application file for complete search history.

(56) References Cited

U.S. PATENT DOCUMENTS 5,963,119 A * 10/1999 Takeda ..... H01F 17/0033 336/206
6,348,850 B1 * 2/2002 Kimura ..... H01F 17/045 336/200

(Continued)

FOREIGN PATENT DOCUMENTS

CN 102893346 A 1/2013
CN 105321653 A 2/2016

(Continued)

OTHER PUBLICATIONS

An Office Action mailed by China National Intellectual Property Administration dated Feb. 3, 2021, which corresponds to Chinese Patent Application No. 201910084847.5 and is related to U.S. Appl. No. 16/243,982 with English language translation.

(Continued)

*Primary Examiner* — Mang Tin Bik Lian

(74) *Attorney, Agent, or Firm* — Studebaker & Brackett PC

(57) ABSTRACT

An inductor component includes a core including a substantially column-shaped shaft and a pair of supports provided at both ends of the shaft; terminal electrodes provided on the supports; a wire wound around the shaft and including end portions connected to the terminal electrodes; and a bottom cover member that covers a boundary portion between the shaft and one of the supports at a bottom of the shaft. The wire is exposed at a side of the shaft.

20 Claims, 10 Drawing Sheets

(56) References Cited

U.S. PATENT DOCUMENTS

| | | | | |
|---|---|---|---|---|
| 6,393,691 | B1 * | 5/2002 | Ogawa | H01F 17/045 29/602.1 |
| 6,480,083 | B1 * | 11/2002 | Toi | H01F 17/045 336/192 |
| 9,966,187 | B2 * | 5/2018 | Aoki | H01F 27/292 |
| 2001/0038327 | A1 * | 11/2001 | Aoki | H01F 27/027 336/83 |
| 2003/0071704 | A1 * | 4/2003 | Toi | H01F 17/045 336/83 |
| 2008/0179445 | A1 * | 7/2008 | Shoji | H01F 17/045 242/570 |
| 2009/0184791 | A1 * | 7/2009 | Fukui | H01F 27/255 335/302 |
| 2010/0026444 | A1 * | 2/2010 | Lee | H01F 27/36 336/84 M |
| 2011/0267167 | A1 * | 11/2011 | Ogawa | H01F 1/12 336/221 |
| 2013/0154784 | A1 * | 6/2013 | Hachiya | H01F 17/045 336/200 |
| 2016/0027574 | A1 * | 1/2016 | Aoki | H01F 17/045 336/192 |
| 2016/0055954 | A1 * | 2/2016 | Huang | H01F 27/292 336/83 |
| 2016/0099106 | A1 * | 4/2016 | Kurokawa | H01L 41/0472 336/200 |
| 2016/0358710 | A1 * | 12/2016 | Yamakita | B29C 70/72 |
| 2017/0125157 | A1 * | 5/2017 | Hess | H01F 27/24 |
| 2017/0169927 | A1 * | 6/2017 | Miyamoto | H01F 17/03 |
| 2017/0263373 | A1 | 9/2017 | Ashizawa et al. | |
| 2019/0096560 | A1 * | 3/2019 | Jang | H01F 27/29 |

FOREIGN PATENT DOCUMENTS

| | | | |
|---|---|---|---|
| JP | S60-176517 | U | 11/1985 |
| JP | H10-135048 | A | 5/1998 |
| JP | 2002-353034 | A | 12/2002 |
| JP | 2006-100701 | A | 4/2006 |
| JP | 2016-031960 | A | 3/2016 |
| JP | 2016-054262 | A | 4/2016 |
| JP | 2017-163099 | A | 9/2017 |

OTHER PUBLICATIONS

An Office Action; "Notification of Reasons for Refusal," mailed by the Japanese Patent Office dated Apr. 14, 2020, which corresponds to Japanese Patent Application No. 2018-014046 and is related to U.S. Appl. No. 16/243,982 with English language translation.

* cited by examiner

INDUCTOR COMPONENT

CROSS-REFERENCE TO RELATED APPLICATION

This application claims benefit of priority to Japanese Patent Application No. 2018-014046, filed Jan. 30, 2018, the entire content of which is incorporated herein by reference.

BACKGROUND

Technical Field

The present disclosure relates to an inductor component.

Background Art

Various types of inductor components are mounted in electronic devices. A wire-wound inductor component includes a core and a wire wound around the core. The core includes a shaft around which the wire is wound and supports that are provided at both ends of the shaft and protrude in directions that cross the axial direction of the shaft. An example of an inductor component includes a cover member that covers a shaft and a wire wound around the shaft between supports (see, for example, Japanese Unexamined Patent Application Publication No. 2016-31960).

SUMMARY

In the above-described inductor component, the shaft is thinner than the supports so that the external size of the inductor component is not affected by the wire wound around the shaft. Therefore, there is a risk that the component will break at the boundaries between the shaft and the supports. In addition, the mechanical strength of the boundaries between the shaft and the supports is easily reduced when the size of the inductor component is reduced. Also, when the shaft is entirely covered with the cover member, there is a risk that degradation of characteristics will occur due to the cover member.

The present disclosure thus provides an inductor component with higher mechanical strength and less degradation of characteristics.

According to preferred embodiments of the present disclosure, an inductor component includes a core including a substantially column-shaped shaft and a pair of supports provided at both ends of the shaft; terminal electrodes provided on the supports; a wire wound around the shaft and including end portions connected to the terminal electrodes; and a bottom cover member that covers a boundary portion between the shaft and one of the supports at a bottom of the shaft. The wire is exposed at a side of the shaft.

With this structure, the mechanical strength of the boundary portion can be increased. In addition, degradation of characteristics due to the side surfaces of the wire being covered by the cover member can be suppressed.

In the above-described inductor component, preferably, the terminal electrode is formed outside the boundary portion, and the bottom cover member directly covers the boundary portion. With this structure, the boundary portion can be directly covered by the bottom cover member, and therefore can be in close contact with the bottom cover member. Accordingly, the mechanical strength can be increased.

In the above-described inductor component, preferably, the bottom cover member is made of a magnetic material. With this structure, since the bottom cover member is made of a magnetic material, a closed magnetic circuit is provided at the bottom. Accordingly, a high-inductance inductor can be obtained by minimizing the reduction in Q factor and increasing the L value acquisition efficiency.

In the above-described inductor component, preferably, the bottom cover member does not project downward beyond the supports. With this structure, since the bottom cover member does not project downward beyond the supports, an increase in the height of the inductor component can be suppressed.

In the above-described inductor component, preferably, a width dimension of the shaft is less than a width dimension of the supports. With this structure, since the width dimension of the shaft is less than the width dimension of the supports, the risk that the wire will project and affect the external shape can be reduced.

Preferably, the above-described inductor component further includes a top cover member that is disposed at least between the supports and covers a top face of the shaft. With this structure, since the top cover member that covers the top face of the shaft is provided, the wire is prevented from being exposed at the top, and the risk of breakage of the wire can be reduced. In addition, the top cover member provided at the top contributes to easy handling of the inductor component in the mounting process.

In the above-described inductor component, preferably, the bottom cover member and the top cover member are apart from each other. With this structure, since the bottom cover member and the top cover member are apart from each other, degradation of characteristics due to the side surfaces of the wire being covered by the cover members can be suppressed.

In the above-described inductor component, preferably, the wire includes a wound portion wound around the shaft, connected portions connected to the terminal electrodes, and extending portions that extend between the wound portion and the connected portions, and the bottom cover member covers one of the extending portions. With this structure, since the extending portions of the wire are covered by the bottom cover member, the risk of breakage of the wire at the extending portions can be reduced.

In the above-described inductor component, preferably, each terminal electrode includes a bottom electrode section on a bottom face of a corresponding one of the supports and an end electrode section on an end face of the corresponding one of the supports, and the end electrode section is higher at a central portion of the end electrode section in a width direction of the end face than at an end portion of the end electrode section in the width direction of the end face. With this structure, the surface area of the end electrode section is greater than that in the case where the central portion and the end portion have the same height. When the surface area is increased, each terminal electrode can be strongly connected to the circuit board. In other words, the fixing force between the inductor component and the circuit board can be increased. Accordingly, the inductor component that is reduced in size can be sufficiently strongly fixed to the circuit board, which is a mounting object. Thus, a reduction in the fixing force can be suppressed.

In the above-described inductor component, preferably, a top edge of the end electrode section is substantially upwardly convex arc-shaped. With this structure, the area of the end electrode section can be further increased. In other words, the surface area of each terminal electrode can be further increased.

In the above-described inductor component, preferably, a ratio of a height of the central portion of the end electrode section in the width direction of the end face to a height of the end portion of the end electrode section in the width direction of the end face is about 1.1 or greater. In the above-described inductor component, preferably, a ratio of a height of the central portion of the end electrode section in the width direction of the end face to a height of the end portion of the end electrode section in the width direction of the end face is about 1.2 or greater.

In the above-described inductor component, preferably, a ratio of a height of the central portion of the end electrode section in the width direction of the end face to a height of the end portion of the end electrode section in the width direction of the end face is about 1.3 or greater. With this structure, the area of the end electrode section can be further increased. In other words, the surface area of each terminal electrode can be further increased.

In the above-described inductor component, preferably, each terminal electrode further includes a side electrode section on a side face of the corresponding one of the supports. Also, heights of the side electrode sections of the terminal electrodes gradually increase with increasing distances from opposing faces of the supports toward the end faces of the supports.

The magnetic flux generated in the shaft of the core by a current that flows through the wire extends from the shaft so as to pass through one support, the air, and the other support, and returns to the shaft. In this inductor component, each terminal electrode does not block the magnetic flux at most parts of the side faces of the corresponding support and the ridges between the end face and the side faces, and causes less reduction in the total amount of magnetic flux. Since the inductor component causes less reduction in the total amount of magnetic flux, the inductance acquisition efficiency can be increased. In addition, since each terminal electrode does not block the magnetic flux at most parts of the ridges, the occurrence of eddy current loss in the terminal electrode can be reduced. This leads to less reduction in Q factor. Since the terminal electrodes are lower at portions adjacent to the opposing faces than at portions adjacent to the end faces, even when the heights of the end electrode sections are increased, solder does not easily interfere with the wire and the shaft near the opposing faces in the mounting process. In particular, since the portions of the electrodes adjacent to the opposing faces are relatively low, the electrodes are not easily covered by the bottom cover member at the opposing faces, and reduction in the contact area between the electrodes and solder can be suppressed.

In the above-described inductor component, preferably, part of the inductor component including the core and the terminal electrodes has a length dimension of less than or equal to about 1.0 mm, a width dimension of less than or equal to about 0.6 mm, and a height dimension of less than or equal to about 0.8 mm. With this structure, a reduction in the fixing force of the inductor component including the core that is reduced in size can be suppressed.

In the above-described inductor component, preferably, the height dimension is greater than the width dimension. With this structure, the height of the end electrode section can be increased relative to a certain mounting area, so that a reduction in the fixing force can be further suppressed.

The present disclosure advantageously provides an inductor component with higher mechanical strength and less degradation of characteristics.

Other features, elements, characteristics and advantages of the present disclosure will become more apparent from the following detailed description of preferred embodiments of the present disclosure with reference to the attached drawings.

DETAILED DESCRIPTION

Embodiments will now be described with reference to the accompanying drawings. In the accompanying drawings, the constituent elements may be enlarged to facilitate understanding. The dimensional ratios between the constituent elements may differ from the actual ratios or those in other figures. In sectional views, the hatching patterns of some constituent elements may be replaced with a satin pattern to facilitate understanding.

First Embodiment

A first embodiment will now be described.

Figure 1B:
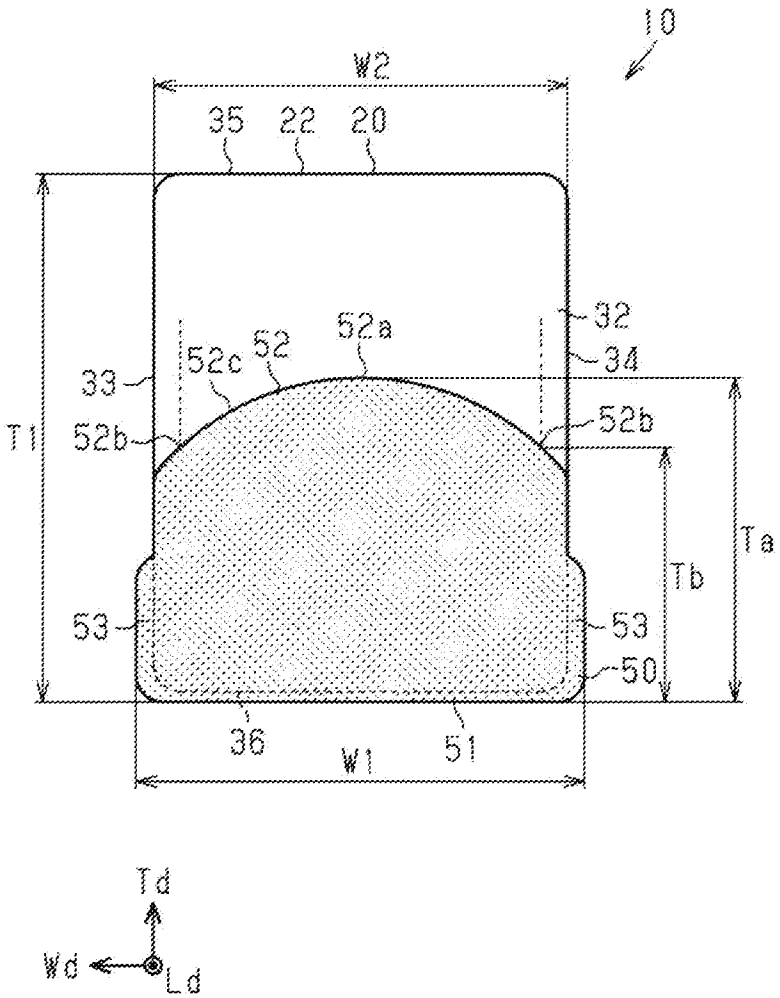
FIG. 1B is an end view of the inductor component.
Figure 1A:
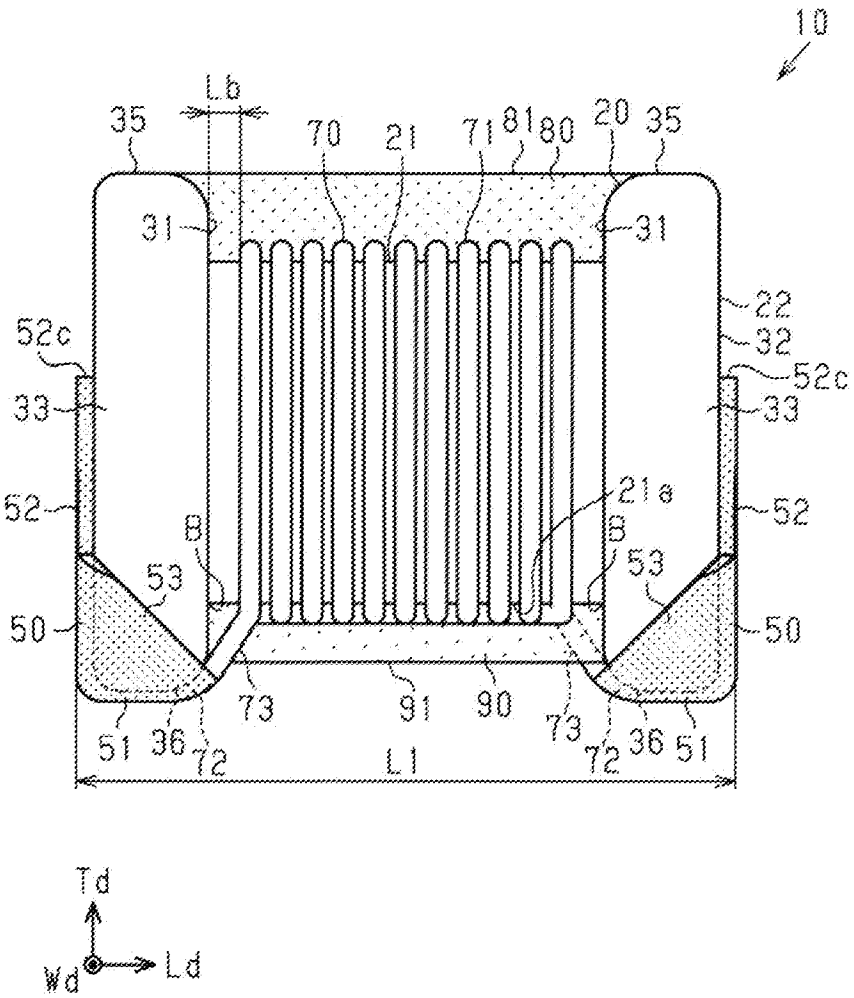
FIG. 1A is a side view of an inductor component according to a first embodiment.
Figure 2:
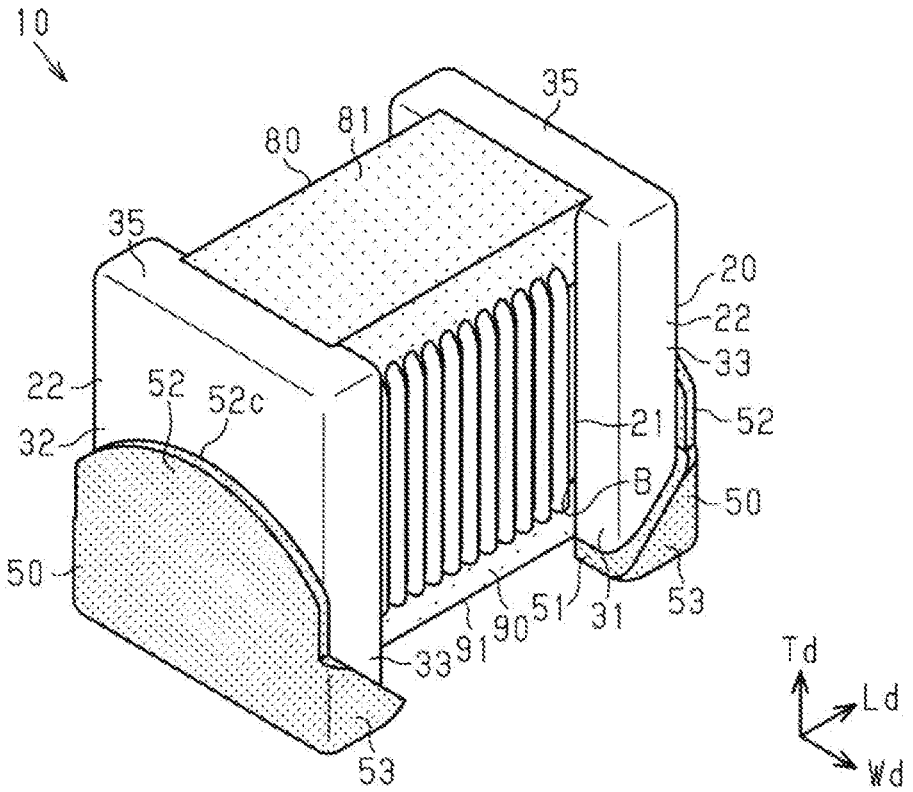
FIG. 2 is a perspective view of the inductor component according to the first embodiment.

An inductor component 10 illustrated in FIGS. 1A, 1B, and 2 is, for example, a surface-mount wire-wound inductor component to be mounted on, for example, a circuit board. The inductor component 10 may be used in various devices including portable electronic devices (mobile electronic devices) such as smart phones and wrist-worn mobile electronic devices (for example, smart watches).

The inductor component 10 according to the present embodiment includes a core 20, a pair of terminal electrodes 50, and a wire 70. The core 20 includes a shaft 21 and a pair of supports 22. The shaft 21 is substantially rectangular parallelepiped shaped. In this specification, the term "rectangular parallelepiped shape" covers the shapes of rectangular parallelepipeds having beveled or rounded corners or ridges. Also, the principal faces and side faces may be uneven either locally or over the entire area thereof. The shape of the shaft 21 is not limited to a substantially rectangular parallelepiped shape, and may instead be other shapes, such as a substantially cylindrical shape and a substantially polygonal prism shape.

The supports 22 are, for example, substantially rectangular parallelepiped shaped and extend from both ends of the shaft 21 in a height direction Td and a width direction Wd that are perpendicular to a length direction Ld in which the shaft 21 extends. The shaft 21 is supported parallel to a mounting object (circuit board) by the supports 22. The supports 22 are formed integrally with the shaft 21.

The terminal electrodes 50 are formed on the respective supports 22. The wire 70 is wound around the shaft 21. The wire 70 is wound around the shaft 21 so as to form, for example, a single layer on the shaft 21. Both end portions of the wire 70 are connected to the respective terminal electrodes 50. The wire 70 may instead be wound around the shaft 21 so as to form a plurality of layers instead of a single layer.

In this specification, the direction in which the shaft 21 extends is defined as the "length direction Ld". Among the directions perpendicular to the "length direction Ld", the vertical direction in FIGS. 1A and 1B is defined as the "height direction (thickness direction) Td", and the direction perpendicular to the "length direction Ld" and the "height direction Td" and parallel to the circuit board is defined as the "width direction Wd". In this case, the width direction Wd is the horizontal direction in FIG. 1B.

The dimension of the inductor component 10 in the length direction Ld (length dimension L1) is preferably greater than about 0 mm and less than or equal to about 1.0 mm (i.e., from greater than about 0 mm to about 1.0 mm). In the present embodiment, the length dimension L1 of the inductor component 10 is, for example, about 0.7 mm.

The dimension of the inductor component 10 in the width direction Wd (width dimension W1) is preferably greater than about 0 mm and less than or equal to about 0.6 mm (i.e., from greater than about 0 mm to about 0.6 mm). The width dimension W1 is preferably less than or equal to about 0.36 mm, and more preferably less than or equal to about 0.33 mm. In the present embodiment, the width dimension W1 of the inductor component 10 is, for example, about 0.3 mm.

The dimension of the inductor component 10 in the height direction Td (height dimension T1) is preferably greater than about 0 mm and less than or equal to about 0.8 mm (i.e., from greater than about 0 mm to about 0.8 mm). In the present embodiment, the height dimension T1 of the inductor component 10 is, for example, about 0.46 mm.

As illustrated in FIG. 1B, the shaft 21 is substantially rectangular parallelepiped shaped and extends in the length direction Ld. The supports 22 are plate-shaped and are thin in the length direction Ld. The supports 22 are rectangular parallelepiped shaped and are longer in the height direction Td than in the width direction Wd. Although the supports 22 are longer in the height direction Td than in the width direction Wd, the supports 22 are not limited to this. For example, the supports 22 may instead have the same length in the width direction Wd and the height direction Td or be longer in the width direction Wd than in the height direction Td.

The supports 22 protrude around the shaft 21 in the height direction Td and the width direction Wd. More specifically, when viewed in the length direction Ld, each support 22 is shaped so as to protrude from the shaft 21 in the height direction Td and the width direction Wd. In other words, a width dimension W2 of each support 22 (see FIGS. 1B and 3) is greater than a width dimension W3 of the shaft 21 (see FIG. 3).

Each support 22 includes an inner face 31, an end face 32, a pair of side faces 33 and 34, a top face 35, and a bottom face 36. The inner faces 31 of the supports 22 face the shaft 21 in the length direction Ld, and also face each other in the length direction Ld. The end faces 32 of the supports 22 face away from the shaft 21 in the length direction Ld, and also face away from each other. The side faces 33 and 34 of each support 22 face away from the shaft 21 in the width direction Wd, and also face away from each other. The top face 35 and the bottom face 36 are at both ends in the height direction Td, and face away from each other. Here, the term "bottom face" means a face that faces the circuit board when the inductor component is mounted on the circuit board. In particular, the bottom face of each support is the face on which a terminal electrode is formed. The term "top face" means a face at the side opposite to the "bottom face". The term "end face" means the face of each support that faces away from the shaft. The term "side face" means a face adjacent to a bottom face and an end face.

Examples of the material of the core 20 include magnetic materials (for example, nickel-zinc (Ni—Zn) ferrites and manganese-zinc (Mn—Zn) ferrites), alumina, and metal magnetic substances. The core 20 can be formed by compression molding and sintering by using powder of the above-mentioned materials. The core 20 may instead be a molded component made of a resin containing magnetic powder.

Figure 4:
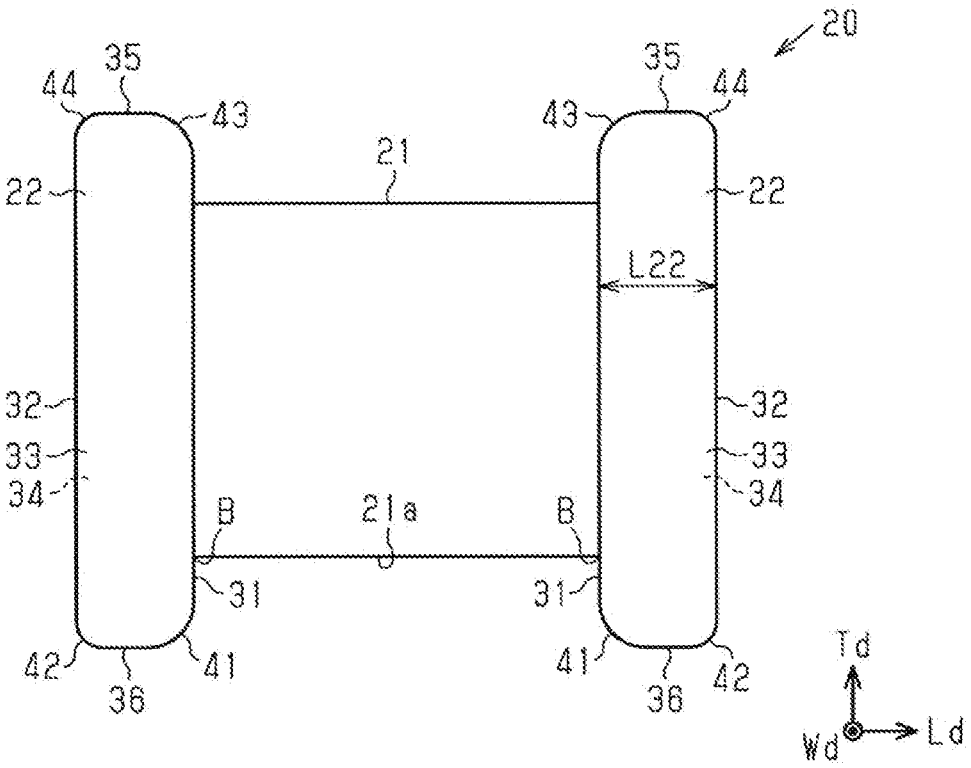
FIG. 4 is a side view of the core.

As illustrated in FIGS. 1A and 4, boundary portions B are provided between the shaft 21 and the supports 22 at the bottom of the shaft 21. The boundary portions B are the boundaries between a bottom face 21*a* of the shaft 21 and the inner faces 31 of the supports 22. The bottom face 21*a* of the shaft 21 and the bottom faces 36 of the supports 22 face in substantially the same direction.

As illustrated in FIG. 4, each support 22 includes a ridge 41 at the boundary between the bottom face 36 and the inner face 31, and a ridge 42 at the boundary between the bottom face 36 and the end face 32. The surfaces of the ridges 41 and 42 are curved convexly toward the outside of the core 20, and are substantially cylindrical (convexly cylindrical). Similarly, each support 22 includes a ridge 43 at the boundary between the top face 35 and the inner face 31, and a ridge 44 at the boundary between the top face 35 and the end face 32. The surfaces of the ridges 43 and 44 are curved convexly toward the outside of the core 20, and are substantially cylindrical (convex cylindrical). Although not illustrated in FIG. 4, each support 22 also includes rounded ridges at the boundaries between the inner face 31 and the side faces 33 and 34 and rounded ridges at the boundaries between the end face 32 and the side faces 33 and 34.

The substantially cylindrical surfaces of the ridges 41 to 44 are arc-shaped in side view. To reduce the risk of damage to the wire 70, the ridges 41 and 43 adjacent to the inner face 31 are formed so that the radii of curvature thereof are greater than those of the ridges 42 and 44 adjacent to the end face 32. For example, the radii of curvature of the ridges 41 and 43 are preferably greater than those of the ridges 42 and 44 by an amount greater than or equal to about 9% of the radii of curvature of the ridges 42 and 44. It has been confirmed that breakage of the wire does not occur in a plurality of inductor components having this structure. The radii of curvature of the ridges 42 and 44 are preferably greater than or equal to about 20 μm. For example, the radii of curvature of the ridges 42 and 44 are preferably in the range of about 20 μm to about 40 μm, and the radii of curvature of the ridges 41 and 43 are preferably in the range of about 25 μm to about 50 μm.

The radii of curvature of the ridges 41 to 44 are set so that the top face 35 and the bottom face 36 of each support 22 are substantially flat. A thickness dimension L22 of each support 22 (thickness in the length direction Ld) is preferably in the range of about 50 μm to about 150 μm. For example, the thickness dimension L22 of each support 22 is about 100 μm, the radius of curvature of the ridge 41 is about 40 μm, and the radius of curvature of the ridge 42 is about 35 μm. In the present embodiment, the radius of curvature of the ridge 43 adjacent to the inner face 31 is greater than the radius of curvature of the ridge 44 adjacent to the end face 32. For example, the radius of curvature of the ridge 43 is about 40 μm, and the radius of curvature of the ridge 44 is about 35 μm.

When the radii of curvature of the ridges 41 and 43 adjacent to the inner face 31 are greater than those of the ridges 42 and 44 adjacent to the end face 32, the manufacturing process can be facilitated. The terminal electrodes 50 of the inductor component 10 are on a side of the core 20 near the bottom faces 36. Each terminal electrode 50 is, for example, formed at the side at which the radius of curvature of the ridge 41 or 43 adjacent to the inner face 31 is greater than that of the ridge 42 or 44 adjacent to the end face 32. If, for example, the above-described relationship between the radii of curvature is satisfied at only one of the top face 35 and the bottom face 36, the side at which the terminal electrode 50 is to be formed needs to be determined, and the core 20 needs to be held in accordance with the result of the determination, which takes a long time. The core 20 according to the present embodiment enables the terminal electrode 50 to be formed thereon without the above-described determination step, and thus the time required to hold the core 20 can be reduced. In the present embodiment, among the two faces that oppose each other in the height direction Td, the face on which the terminal electrode 50 is formed is the bottom face 36, and the face at the side opposite to the bottom face 36 in the height direction Td is the top face 35. When it is not necessary to achieve the above-described effect, the radii of curvature of the ridges adjacent to the top face 35 do not need to satisfy the above-described relationship.

The supports 22 include the inner faces 31 that are vertical. The inner faces 31 efficiently provide a region (space) in which the wire 70 can be wound around the shaft 21 between the supports 22.

Figure 3:
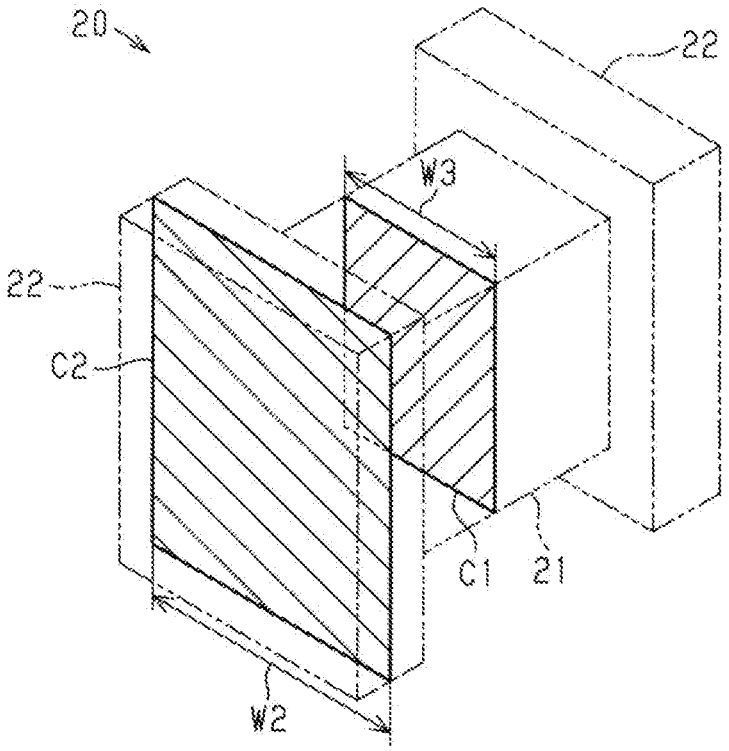
FIG. 3 is a schematic perspective view illustrating cross sections of a core.

Referring to FIG. 3, the area of a cross section C1 of the shaft 21 taken perpendicular to the axial direction (length direction Ld) is preferably in the range of about 35% to about 75%, and more preferably about 40% to about 70%, of the area of a cross section C2 of each support 22 taken perpendicular to the axial direction. The area of the cross section C1 of the shaft 21 is more preferably in the range of about 45% to about 65%, and still more preferably in the range of about 50% to about 60%, of the area of the cross section C2 of each support 22. In the present embodiment, the area of the cross section C1 of the shaft 21 is about 55% of the area of the cross section C2 of the support 22.

When the ratio of the area of the cross section C1 of the shaft 21 to the area of the cross section C2 of each support 22 is set in a predetermined range as described above, the design flexibility of the inductor component 10 (core 20) can be increased by using the space between the shaft 21 and the end portions of the supports 22 in the directions perpendicular to the length direction Ld (width direction Wd and height direction Td). When, for example, the ratio of the area of the cross section C1 of the shaft 21 to the area of the cross section C2 of each support 22 is greater than a certain ratio, the strength of the core 20 can be increased. In addition, the amount of saturation of magnetic flux that passes through the core 20 can be increased, which leads to less degradation of characteristics. When the ratio of the area of the cross section C1 of the shaft 21 to the area of the cross section C2 of each support 22 is small, the risk that the wire 70 wound around the core 20 will protrude from the end portions of the supports 22 can be reduced.

With regard to the design flexibility, the characteristics of the inductor component 10 may be set by setting the position of the shaft 21 relative to the supports 22. For example, when the shaft 21 is shifted toward the top faces 35 of the supports 22 and located at a high position, the amount of parasitic capacitance between the wire 70 and each of the wires and pads on the circuit board having the inductor component 10 mounted thereon can be reduced. Accordingly, the self-resonance frequency can be increased. When the shaft 21 is shifted toward the bottom faces 36 of the supports 22 and located at a low position, the inner faces 31 of the supports 22 face each other over a large area above the shaft 21. Therefore, magnetic flux is easily generated between the supports 22. Accordingly, the inductance can be set to a desired value, and the impedance can be increased.

As illustrated in FIGS. 1A and 1B, each terminal electrode 50 includes a bottom electrode section 51 formed on the bottom face 36 of the corresponding support 22. The bottom electrode section 51 is formed over the entire area of the bottom face 36 of the support 22.

Each terminal electrode 50 also includes an end electrode section 52 formed on the end face 32 of the corresponding support 22. The end electrode section 52 is formed so as to cover a portion (lower portion) of the end face 32 of the support 22. The end electrode section 52 is connected to the bottom electrode section 51 by a portion on the ridge between the end face 32 and the bottom face 36.

As illustrated in FIG. 1B, the end electrode section 52 on the end face 32 of the support 22 is higher at a central portion 52*a* in the width direction Wd than at end portions 52*b* in the width direction Wd. A top edge 52*c* of the end electrode section 52 is substantially upwardly convex arc-shaped (convex toward the top face 35). The end portions 52*b* of the end electrode section 52 are above side electrode sections 53 on the side faces 33 and 34.

The ratio of a height Ta of the central portion 52*a* of the end electrode section 52 to a height Tb of the end portions 52*b* of the end electrode section 52 is preferably greater than or equal to about 1.1, and more preferably greater than or equal to about 1.2. In the present embodiment, the height ratio is greater than or equal to about 1.3. When viewed in a direction perpendicular to the end face 32, the height of the end electrode section 52 is a length (height) from the surface (bottom end) of the bottom electrode section 51 to the edge (top end) of the end electrode section 52 in the height direction Td. In particular, the height Tb of the end portions

52*b* is the height at the ends of a substantially flat portion of the end face 32 in the width direction.

In FIG. 1B, the ends of the substantially flat portion of the end face 32 are indicated by broken lines. The core 20 has rounded ridges at the boundaries between the end face 32 and the side faces 33 and 34. The ridges are formed by, for example, barrel finishing. The height of the end electrode section 52 easily varies at the ridges because the position of the bottom end varies. Therefore, the end portions 52*b* of the end electrode section 52 are defined as the portions at the ends of the substantially flat portion of the end face 32 in the width direction. In the case where the substantially flat portion of the end face 32 does not have clear ends, the end portions 52*b* may be defined as portions that are about 50 μm inward from the side faces 33 and 34 of the support 22 in FIG. 1B.

The width dimension W1 and the height dimension T1 of the inductor component 10 are preferably such that the height dimension T1 is greater than the width dimension W1 (T1>W1). In such a case, the height of the end electrode section 52 can be increased relative to a certain mounting area, and the fixing force can be increased accordingly.

As illustrated in FIG. 1B, each terminal electrode 50 includes the side electrode sections 53 formed on the side faces 33 and 34 of the corresponding support 22. As illustrated in FIG. 1A, the side electrode sections 53 of the terminal electrodes 50 cover portions (lower portions) of the side faces 33 of the respective supports 22. The side electrode sections 53 are connected to the bottom electrode sections 51 and the end electrode sections 52 by portions of the terminal electrodes 50 on the ridges. The side electrode sections 53 are formed so that the heights thereof gradually increase with increasing distances from the opposing inner faces 31 toward the end faces 32 of the supports 22, that is, so that the top edges of the terminal electrodes 50 are inclined on the side faces 33 of the supports 22. In the present embodiment, the height of the side electrode sections 53 at the ends adjacent to the end faces 32 is greater than the height of the bottom face of the shaft 21 (distance from the bottom faces 36 of the core 20 to the bottom face of the shaft 21). Although the side electrode sections 53 on the side faces 33 are illustrated in FIG. 1A, the side electrode sections on the side faces 34 illustrated in FIG. 1B have a similar structure. As described above, the bottom electrode sections 51, the end electrode sections 52, and the side electrode sections 53 do not include portions of the terminal electrodes 50 on the ridges between the end faces 32, the side faces 33 and 34, and the bottom faces 36.

Figure 5:
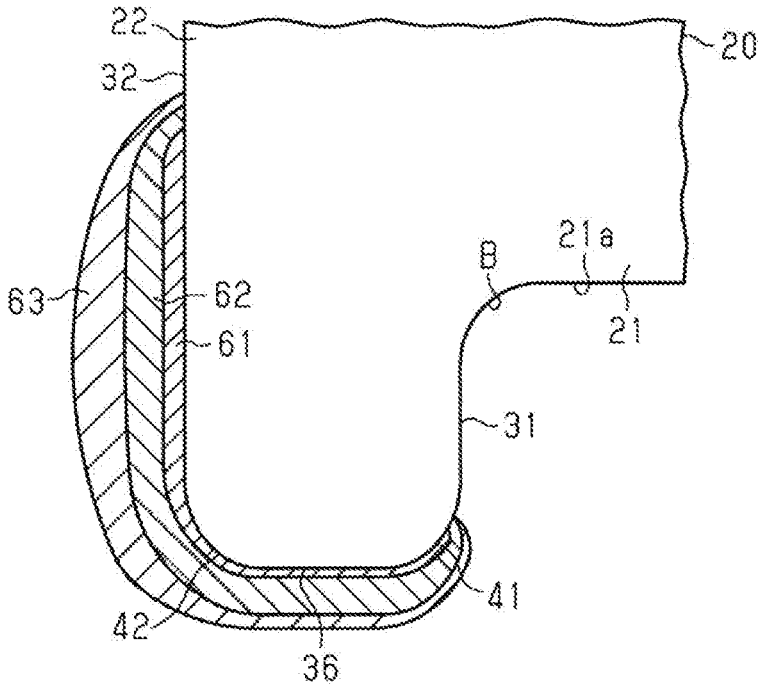
FIG. 5 is an enlarged sectional view of a terminal electrode.

As illustrated in FIG. 5, each terminal electrode 50 includes an underlying layer 61 formed on a surface of the core 20 and plating layers 62 and 63 that cover the underlying layer 61. The thickness of a portion of the underlying layer 61 that covers the end face 32 is greater than the thickness of a portion of the underlying layer 61 that covers the bottom face 36. The underlying layer 61 is a metal layer containing, for example, silver (Ag) as a main component. The underlying layer 61 may additionally contain, for example, silica and resin. The plating layer 62 may be formed of, for example, a metal such as nickel (Ni) or copper (Cu), or an alloy such as Ni-chromium (Cr) or Ni—Cu. The plating layer 63 may be made of, for example, a metal such as tin (Sn).

The underlying layer 61 is formed by, for example, applying and baking a conductive paste. The plating layers 62 and 63 are formed by, for example, electroplating.

Figure 6A:
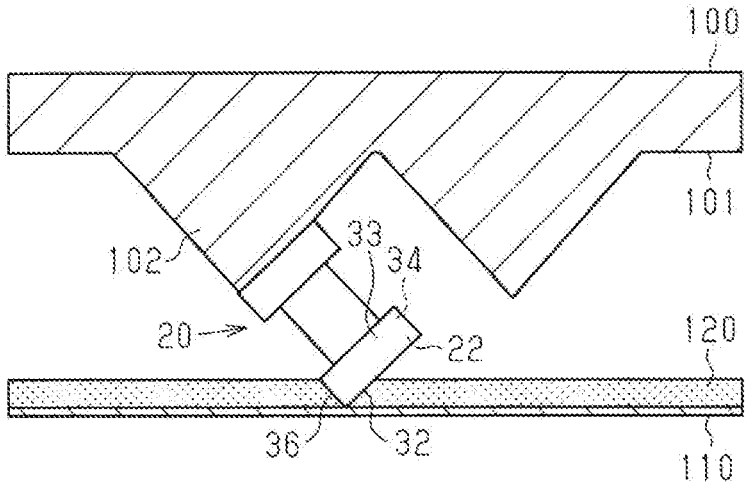
FIGS. 6A to 6C are schematic diagrams illustrating steps for forming the terminal electrode.
Figure 6B:
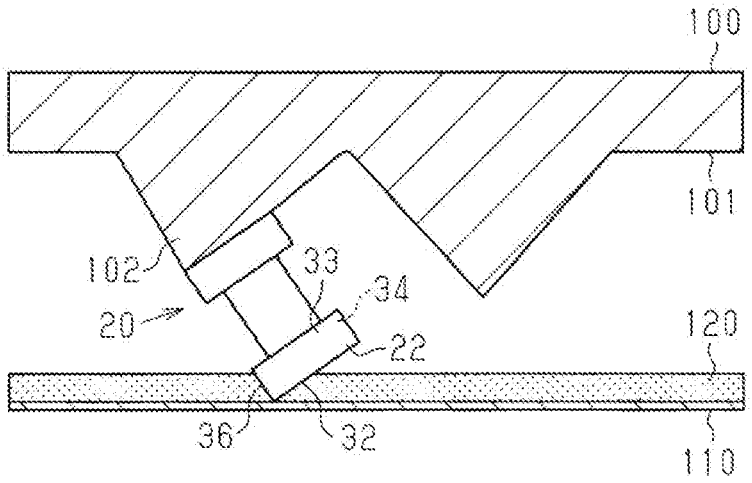
Figure 6C:
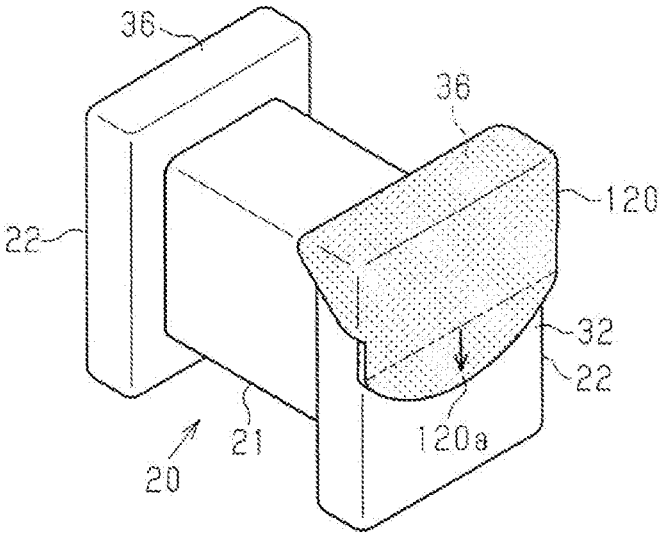

FIGS. 6A to 6C illustrate exemplary steps for forming the terminal electrode 50, more specifically, exemplary steps for forming the underlying layer 61.

First, as illustrated in FIG. 6A, the core 20 is attached to a holder 100. The holder 100 includes a holding portion 102 that holds the core 20 with the axial direction of the core 20 inclined relative to a lower face 101 of the holder 100.

The holder 100 is adhesive and elastic, and holds the core 20 in a removable manner. The holder 100 may be made of, for example, silicone rubber.

Conductive paste 120 is contained in a reservoir 110. The conductive paste 120 is, for example, silver (Ag) paste. The bottom face 36 of one of the supports 22 of the core 20 is immersed in the conductive paste 120. At this time, the core 20 is brought into contact with the reservoir 110 in such a manner that the holder 100 (holding portion 102) is not deformed. In this step, the conductive paste 120 adheres to the side faces 33 and 34 and the end face 32 of the support 22 so as to be connected to the conductive paste 120 on the bottom face 36. The conductive paste 120 adheres to the side faces 33 and 34 of the support 22 so that the height thereof from the bottom face 36 increases with increasing distance from the inner face 31 that opposes the inner face 31 of the other support 22 toward the end face 32.

Next, as illustrated in FIG. 6B, the holder 100 is pushed toward the reservoir 110. The holder 100 is elastic, and therefore allows a change in position of the core 20 held by the holder 100. The core 20 changes its position so as to change the inclination of the shaft 21 of the core 20. In the present embodiment, the core 20 is caused to change its position so that the shaft 21 of the core 20 becomes more perpendicular to the surface of the conductive paste 120. In this step, the conductive paste 120 adheres to the end face 32 of the support 22 so that the height thereof from the bottom face 36 of the support 22 is greater than that of the conductive paste 120 on the side faces 33 and 34. The top edge of the conductive paste 120 on the end face 32 is substantially straight.

Next, as illustrated in FIG. 6C, the core 20 is placed so that the bottom face 36 of the support 22 faces upward (vertically upward). The viscosity of the conductive paste 120 may be adjusted, for example, so that the conductive paste 120 on the end face 32 moves (expands) vertically downward along the end face 32 from the position indicated by the two-dot chain line due to its own weight. The conductive paste 120 moves (expands) vertically downward so that a central portion of a bottom edge 120*a* of the conductive paste 120 in the width direction protrudes by a largest amount and reaches a lowest position in the state illustrated in FIG. 6C. The conductive paste 120 is dried in this state. The conductive paste 120 is also applied to the other support 22 in a similar manner, and is dried. Then, the conductive paste 120 on the core 20 is baked to form the underlying layer 61 (electrode film) illustrated in FIG. 5.

Then, the plating layers 62 and 63 illustrated in FIG. 5 are formed on the surface of the underlying layer 61 by, for example, electroplating. The terminal electrodes 50 are formed by the above-described steps.

As illustrated in FIG. 5, each terminal electrode 50 is formed so that the bottom electrode section 51 on the bottom face 36 of the core 20 and the end electrode section 52 on the end face 32 of the core 20 are connected to each other. The ridge 42 between the bottom face 36 and the end face 32 of the core 20 is rounded at the boundary between the bottom face 36 and the end face 32. The radius of curvature of the ridge 42 is greater than or equal to about 20 μm (35 μm in the present embodiment). Such a ridge 42 facilitates formation of the terminal electrode 50 that continuously extends from the bottom face 36 of the core 20 to the end face 32 of the core 20.

When the core has a ridge 42 whose radius of curvature is less than about 20 μm or when the core does not have a rounded ridge 42, the thickness of the terminal electrode (underlying layer) on the ridge at the boundary between the bottom face and the end face is reduced, and the bottom electrode section and the end electrode section are easily disconnected. In contrast, when the radius of curvature of the ridge 42 is greater than or equal to about 20 μm, the terminal electrode 50 (underlying layer 61) has a sufficient thickness at the ridge 42. Therefore, the bottom electrode section 51 and the end electrode section 52 are not easily disconnected.

As illustrated in FIG. 1B, the wire 70 is wound around the shaft 21. The wire 70 includes, for example, a core having a substantially circular cross section and a cladding that covers the surface of the core. The core may be made of, for example, a material containing a conductive material, such as Cu and Ag, as a main component. The cladding may be made of, for example, an insulating material, such as polyurethane and polyester. Both end portions of the wire 70 are electrically connected to the respective terminal electrodes 50. The wire 70 may be connected to the terminal electrodes 50 by, for example, soldering. More specifically, the plating layer 63 of each terminal electrode 50 may be formed of a Sn layer, and the wire 70 may be connected to the terminal electrode 50 by thermally pressure-bonding a portion of the wire 70 in which the cladding is removed and the core is exposed to the plating layer 63. The connecting method is not limited to this, and various known methods may be used.

The diameter of the wire 70 is preferably in the range of, for example, about 14 μm to about 30 μm, and more preferably in the range of about 15 μm to about 28 μm. In the present embodiment, the diameter of the wire 70 is about 20 μm. When the diameter of the wire 70 is greater than a certain value, an increase in the resistance component can be suppressed. When the diameter of the wire 70 is less than a certain value, the wire 70 can be prevented from protruding from the core 20.

As illustrated in FIG. 1A, the wire 70 includes a wound portion 71 wound around the shaft 21, connected portions 72 connected to the terminal electrodes 50, and extending portions 73 that extend between the wound portion 71 and the connected portions 72. The connected portions 72 are connected to the bottom electrode sections 51 of the terminal electrodes 50, the bottom electrode sections 51 being formed on the bottom faces 36 of the supports 22.

The wire 70 is wound around the shaft 21 with spaces provided between the wire 70 and the supports 22. In other words, end portions 71*a* and 71*b* of the wound portion 71 are spaced from the supports 22 of the core 20. The distance Lb from the end portions 71*a* and 71*b* of the wound portion 71 to the supports 22 is, for example, preferably less than or equal to about 5 times the diameter of the wire 70, and more preferably less than or equal to about 4 times the diameter of the wire 70. In the present embodiment, the distance Lb between the wire 70 and the supports 22 is less than or equal to about 3 times the diameter of the wire 70.

The distance from the end portions 71*a* and 71*b* of the wound portion 71 to the supports 22 affects the length of the extending portions 73. The extending portions 73 connect the wound portion 71 to the connected portions 72, which are connected to the bottom electrode sections 51 of the terminal electrodes 50 formed on the supports 22. Therefore, when the end portions 71*a* and 71*b* of the wound portion 71 are spaced from the supports 22 by a large distance, the extending portions 73 are long and are spaced from the supports 22 and the shaft 21 by a large distance. In such a case, there is a risk that the extending portions 73 will be damaged or the wire 70 will break. There is also a risk that the wire 70 will be loosened due to the extending portions 73, protrude from the end portions of the supports 22, and be damaged. These risks can be reduced by appropriately setting the distance from the end portions 71*a* and 71*b* of the wound portion 71 to the supports 22.

As illustrated in FIGS. 1A and 2, the inductor component 10 includes a top cover member 80 and a bottom cover member 90. The top cover member 80 and the bottom cover member 90 are separate members that are provided independently of each other. In other words, the top cover member 80 and the bottom cover member 90 are not connected to each other.

The top cover member 80 is disposed between the supports 22 and covers the wire 70 near the top faces 35. The top cover member 80 may be made of, for example, epoxy resin.

The top cover member 80 enables reliable suction by a suction nozzle when, for example, the inductor component 10 is mounted on the circuit board. The top cover member 80 also prevents the wire 70 from being damaged during suction by the suction nozzle. When the top cover member 80 is made of a magnetic material, the inductance (L value) of the inductor component 10 can be increased. When the top cover member 80 is made of a non-magnetic material, magnetic loss can be reduced and the Q factor of the inductor component 10 can be increased.

The bottom cover member 90 is disposed between the supports 22 and covers the wire 70 including the extending portions 73 near the bottom faces 36. The bottom cover member 90 has a bottom face 91 that is substantially flat. The bottom cover member 90 covers the boundary portions B between the shaft 21 and the supports 22. When the bottom cover member 90 is made of a magnetic material, the inductance (L value) of the inductor component 10 can be increased. When the bottom cover member 90 is made of a non-magnetic material, magnetic loss can be reduced and the Q factor of the inductor component 10 can be increased. The bottom cover member 90 may be formed by, for example, applying a resin to the shaft 21 in the region between the supports 22 by using a dispenser or the like, holding the applied resin in a substantially flat shape with a film, and then drying the resin. At this time, the height (thickness) of the bottom cover member 90 from the shaft 21 in the height direction Td is set so that the bottom cover member 90 does not project beyond the supports 22. The bottom cover member 90 may be formed by a method other than the above-described method. For example, when a thermoplastic resin is used as the material, the bottom cover member 90 may be formed by heating the thermoplastic resin. When a UV curing resin is used as the material, the bottom cover member 90 may be formed by irradiating the UV curing resin with UV light.

Effects

The effects of the inductor component 10 will now be described.

The bottom cover member 90 of the inductor component 10 according to the present embodiment is disposed between the supports 22 and covers the boundary portions B between the shaft 21 and the supports 22 near the bottom faces 36. The bottom cover member 90 ensures sufficient mechanical strength even when the boundary portions B of the inductor component 10 receive stress. Accordingly, the risk that the inductor component 10 will break at the boundary portions B can be reduced. In addition, since the bottom cover member 90 and the top cover member 80 are apart from each other and the side surfaces of the wire 70 are exposed, degradation of characteristics due to the wire 70 being covered by the cover members 80 and 90, such as an increase in stray capacitance due to ε characteristics and a reduction in Q factor due to tan δ of the material of the top cover member 80 and the bottom cover member 90, can be suppressed. In addition, when the bottom cover member 90 is made of, for example, a magnetic resin, that is, a magnetic material, a closed magnetic circuit is provided at the bottom of the inductor component 10. Accordingly, a high-inductance inductor component 10 can be obtained by minimizing the reduction in Q factor and increasing the L value acquisition efficiency.

Each terminal electrode 50 of the inductor component 10 according to the present embodiment includes the end electrode section 52 formed on the end face 32 of the core 20 (support 22). The end portions 52*b* of the end electrode section 52 are higher than the side electrode sections 53 on the side faces 33 and 34, and the surface area of the terminal electrode 50 is increased accordingly. When the surface area is increased, the terminal electrode 50 can be strongly connected to the circuit board. In other words, the fixing force between the inductor component 10 and the circuit board can be increased.

The end electrode section 52 is higher at the central portion 52*a* in the width direction of the end face 32 than at the end portions 52*b* in the width direction. Accordingly, the surface area of the end electrode section 52 is greater than that in the case where the central portion 52*a* and the end portions 52*b* have the same height. Thus, the terminal electrode 50 can be strongly connected to the circuit board. In other words, the fixing force between the inductor component 10 and the circuit board can be increased. Furthermore, the top edge 52*c* of the end electrode section 52 is substantially upwardly convex arc-shaped. When the top edge 52*c* is arc-shaped, the surface area of the terminal electrode 50 can be further increased.

When the inductor component 10 is soldered to pads on the circuit board, solder fillet extends along the central portion 52*a* of the end electrode section 52. Since the end electrode section 52 of the inductor component 10 is higher at the central portion 52*a* than at the end portions 52*b*, the height to which the solder extends can be increased. Thus, the inductor component 10 that is reduced in size can be sufficiently strongly fixed to the circuit board, which is a mounting object. The fixing force of the inductor component 10 is, for example, about 5.22 N.

In the present embodiment, the height dimension T1 of the inductor component 10 is greater than the width dimension W1 of the inductor component 10 (T1>W1). Therefore, the height of the end electrode section 52 can be increased relative to a certain mounting area, and the fixing force can be increased.

The terminal electrodes 50 according to the present embodiment are effective in achieving the inductance required of the inductor component 10. More specifically, the magnetic flux generated in the shaft 21 of the core 20 by the wire 70 extends from the shaft 21 so as to pass through one support 22, the air, and the other support 22, and returns to the shaft 21. In the inductor component 10 according to the present embodiment, the heights of the end portions 52*b* and the side electrode sections 53 connected to the end portions 52*b* are smaller than the height of the central portion 52*a*. Therefore, each terminal electrode 50 does not block the magnetic flux at most parts of the side faces 33 and 34 of the corresponding support 22 and the ridges between the end face 32 and the side faces 33 and 34, and causes less reduction in the total amount of magnetic flux. A reduction in the total amount of magnetic flux causes a reduction in the inductance, and therefore the desired inductance (inductance corresponding to the design of the core) cannot be obtained. According to the present embodiment, since the inductor component 10 causes less reduction in the total amount of magnetic flux, the inductance acquisition efficiency can be increased. For example, the inductance of the inductor component 10 may be about 560 nH for an input signal having a frequency of about 10 MHz. In addition, since each terminal electrode 50 does not block the magnetic flux at most parts of the ridges as described above, the occurrence of eddy current loss in the terminal electrode 50 can be reduced. This leads to less reduction in Q factor.

The terminal electrodes 50 include the side electrode sections 53 on the side faces 33 and 34 of the supports 22. The heights of the side electrode sections 53 gradually increase with increasing distances from the inner faces 31 toward the end faces 32 of the supports 22. In other words, the side electrode sections 53 are lower at the ends adjacent to the inner faces 31 than at the ends adjacent to the end faces 32. Therefore, even when the heights of the end electrode sections 52 are increased, solder does not easily interfere with the wire 70 and the shaft 21 in the regions near the inner faces 31 in the mounting process.

Since the thicknesses of the end electrode sections 52 and the side electrode sections 53 can be increased, the center of gravity of the inductor component 10 is low. This enables the inductor component 10 to be easily placed in a stable position in the mounting process.

Figure 7:
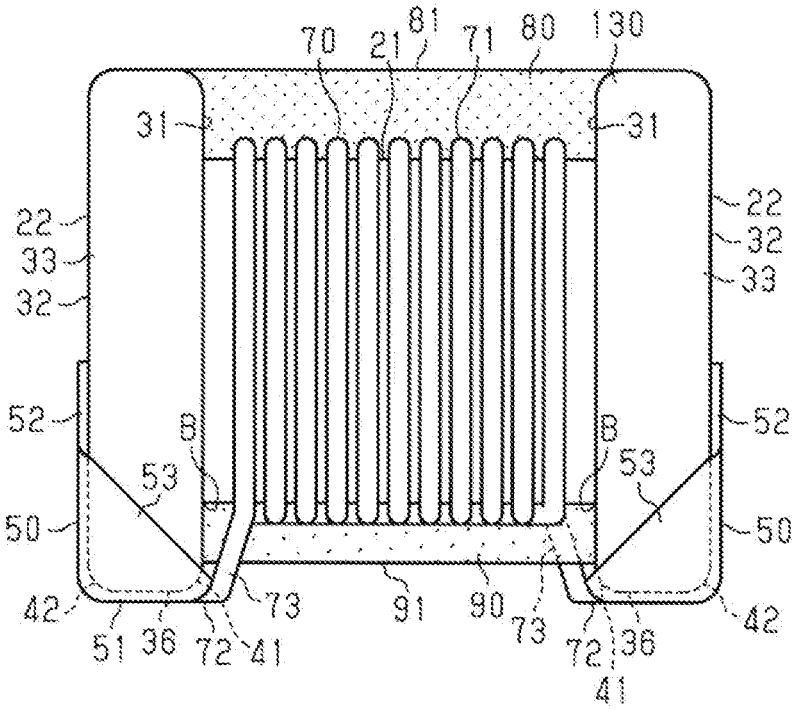
FIG. 7 is a side view of an inductor component according to a reference example.

FIG. 7 illustrates a core 130 according to a comparative example. In the comparative example, constituent members that are the same as those in the present embodiment are denoted by the same reference numerals to facilitate understanding of comparison between the comparative example and the present embodiment. In the core 130 of the comparative example, the ridges 41 adjacent to the inner faces 31 and the ridges 42 adjacent to the end faces 32 have the same radius of curvature (for example, 20 μm). In this case, the wire 70 is curved with a small radius of curvature at the ridges 41, and force is concentrated at the curved portions. Therefore, when the diameter of the wire 70 is less than or equal to a certain value (for example, about 20 μm), there is a risk that the wire 70 will be reduced in thickness or break.

In contrast, in the core 20 according to the present embodiment illustrated in FIG. 1A, the radius of curvature of the ridges 41 adjacent to the inner faces 31 is greater than that of the ridges 42 adjacent to the end faces 32, and is, for example, about 40 μm. Therefore, the wire 70 is curved with a large radius of curvature at the ridges 41, and the concentration of force is reduced. Thus, breakage of the wire 70, for example, does not easily occur.

In addition, the extending portions 73 that extend between the shaft 21 and the terminal electrodes 50 (portions that are in midair and not in contact with the core 20) are shorter than those in the comparative example illustrated in FIG. 7. When the extending portions 73 are long, there is a risk that the extending portions 73 will be damaged or the wire 70 will break. There is also a risk that the wire 70 will be loosened due to the extending portions 73, protrude from the end portions of the supports 22, and be damaged. In the present embodiment, these risks are reduced because the extending portions 73 are shorter than those in the comparative example.

When the radius of curvature of the ridges 41 is greater than a certain value, the risk of breakage of the wire 70, for example, can be reduced. When the radius of curvature of the ridges 41 is less than a certain value, the area of the bottom faces 36 of the supports 22 can be increased to ensure stable mounting.

The above-described embodiment has the following effects.

(1-1) Since the boundary portions B between the shaft 21 and the supports 22 are covered by the bottom cover member 90, the mechanical strength of the boundary portions B can be increased. In addition, since the wire 70 is exposed at the sides of the shaft 21, degradation of characteristics due to the side surfaces of the wire 70 being covered by the bottom cover member 90 and the top cover member 80 can be suppressed.

(1-2) Since the terminal electrodes 50 are formed at positions outside the boundary portions B, the boundary portions B can be directly covered by the bottom cover member 90, and therefore can be in close contact with the bottom cover member 90. Accordingly, the mechanical strength can be increased.

(1-3) When the bottom cover member 90 is made of a magnetic material, a closed magnetic circuit is provided at the bottom. Accordingly, a high-inductance inductor component 10 can be obtained by minimizing the reduction in Q factor and increasing the L value acquisition efficiency.

(1-4) Since the bottom cover member 90 does not project downward beyond the supports 22, an increase in the size of the inductor component 10 can be suppressed.

(1-5) Since the width dimension W2 of the shaft 21 is less than the width dimension W3 of the supports 22, the risk that the wire 70 will project and affect the external shape can be reduced.

(1-6) Since the top cover member 80 that covers the top face of the shaft 21 is provided, the wire 70 is prevented from being exposed at the top, and the risk of breakage of the wire 70 can be reduced. In addition, the top cover member 80 provided at the top contributes to easy handling of the inductor component 10 in the mounting process.

(1-7) Since the top cover member 80 and the bottom cover member 90 are apart from each other, an increase in stray capacitance due to ε characteristics and a reduction in Q factor due to tan δ of the material of the top cover member 80 and the bottom cover member 90 can be suppressed.

(1-8) Since the extending portions 73 of the wire 70 are covered by the bottom cover member 90, the risk of breakage of the wire 70 at the extending portions 73 can be reduced.

(1-9) The inductor component 10 includes the core 20, the pair of terminal electrodes 50, and the wire 70. The core 20 includes the shaft 21 and the pair of supports 22. The shaft 21 is substantially rectangular parallelepiped shaped. The supports 22 are connected to both ends of the shaft 21. The shaft 21 is supported parallel to a mounting object (circuit board) by the supports 22. The supports 22 are formed integrally with the shaft 21.

Each terminal electrode 50 includes the end electrode section 52 formed on the end face 32 of the support 22. The end electrode section 52 is higher at the central portion 52*a* in the width direction of the end face 32 than at the end portions 52*b* in the width direction. Owing to the end electrode section 52, the surface area of the terminal electrode 50 is increased. When the surface area is increased, the terminal electrode 50 can be strongly connected to the circuit board. In other words, the fixing force between the inductor component 10 and the circuit board can be increased. Accordingly, the inductor component 10 that is reduced in size can be sufficiently strongly fixed to the circuit board, which is a mounting object. Thus, a reduction in the fixing force can be suppressed. Furthermore, the top edge 52*c* of the end electrode section 52 is substantially upwardly convex arc-shaped. Thus, the surface area of the end electrode section 52 can be further increased. In other words, the surface area of the terminal electrode 50 can be further increased.

(1-10) The height dimension T1 of the inductor component 10 is greater than the width dimension W1 of the inductor component 10 (T1>W1). Therefore, the height of the end electrode section can be increased relative to a certain mounting area, and the fixing force can be increased.

(1-11) Each terminal electrode 50 includes the side electrode sections 53 that cover the bottom portions of the side faces 33 and 34 of the corresponding support 22. The magnetic flux generated in the shaft 21 of the core 20 by the wire 70 extends from the shaft 21 so as to pass through one support 22, the air, and the other support 22, and returns to the shaft 21. In the inductor component 10 according to the present embodiment, the heights of the end portions 52*b* and the side electrode sections 53 connected to the end portions 52*b* are smaller than the height of the central portion 52*a*. Therefore, each terminal electrode 50 does not block the magnetic flux at most parts of the side faces 33 and 34 of the corresponding support 22 and the ridges between the end face 32 and the side faces 33 and 34, and causes less reduction in the total amount of magnetic flux. A reduction in the total amount of magnetic flux causes a reduction in the inductance, and therefore the desired inductance (inductance corresponding to the design of the core) cannot be obtained. According to the present embodiment, since the inductor component 10 causes less reduction in the total amount of magnetic flux, the inductance acquisition efficiency can be increased. In addition, since each terminal electrode 50 does not block the magnetic flux at most parts of the ridges of the support 22, the occurrence of eddy current loss in the terminal electrode 50 can be reduced. This leads to less reduction in Q factor.

Second Embodiment

A second embodiment will now be described.

In this embodiment, constituent members that are the same as those in the above-described embodiment are denoted by the same reference numerals, and description thereof may be partially or entirely omitted.

Figure 8B:
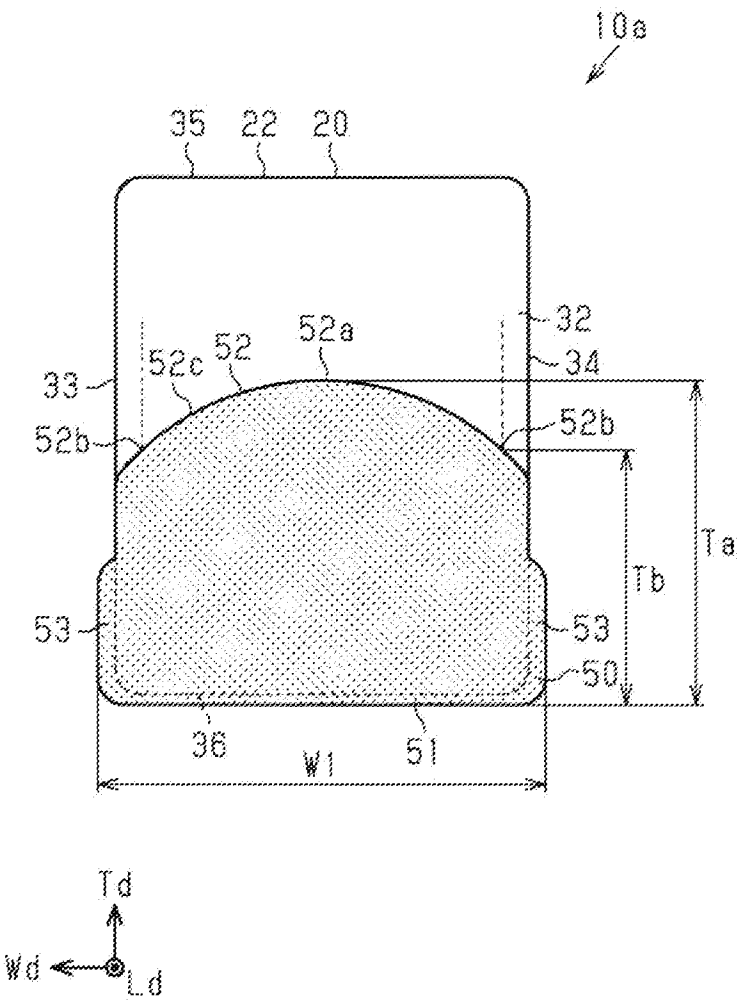
FIG. 8B is an end view of the inductor component.
Figure 8A:
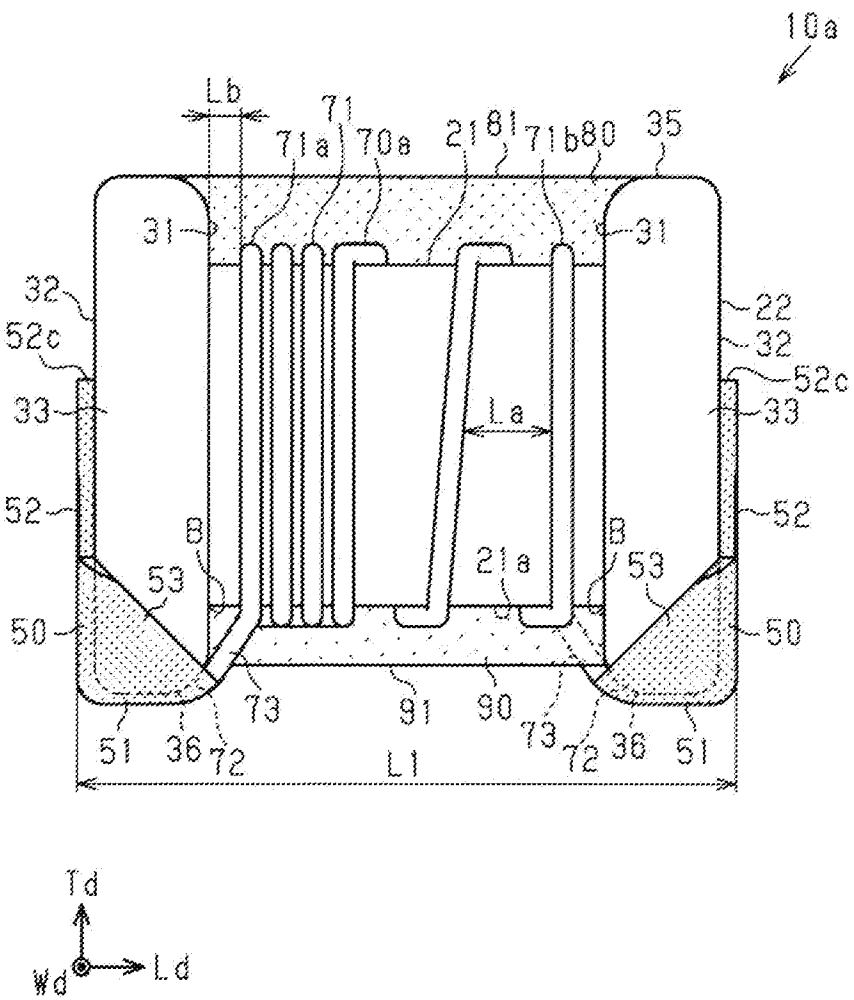
FIG. 8A is a side view of an inductor component according to a second embodiment.
Figure 9:
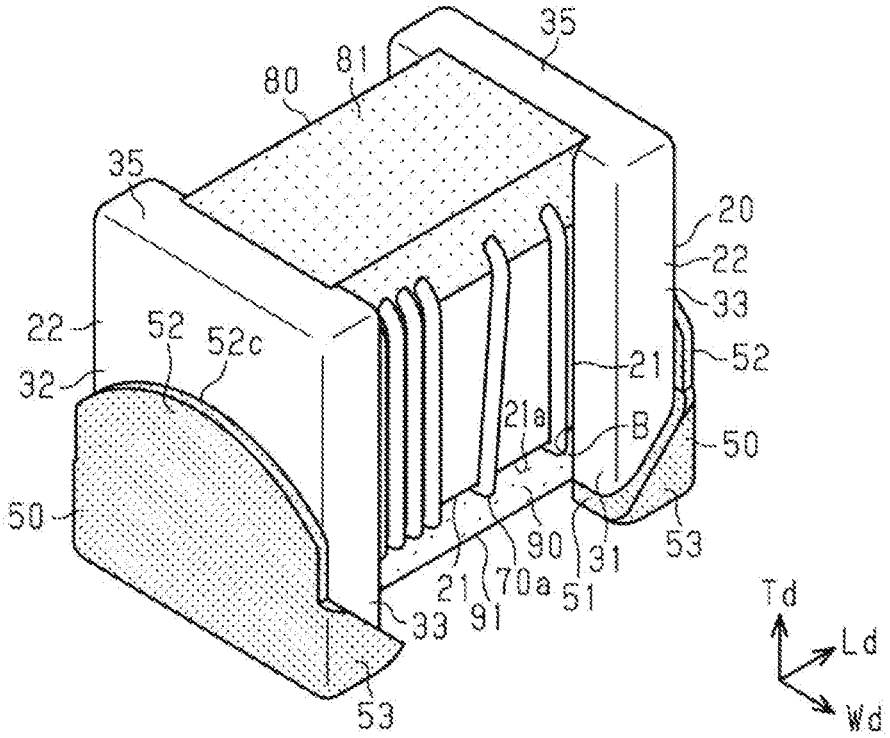
FIG. 9 is a perspective view of the inductor component according to the second embodiment.

An inductor component 10*a* illustrated in FIGS. 8A, 8B, and 9 is, for example, a surface-mount wire-wound inductor component to be mounted on, for example, a circuit board. The inductor component 10*a* may be used in various devices including portable electronic devices (mobile electronic devices) such as smart phones and wrist-worn mobile electronic devices (for example, smart watches).

The inductor component 10*a* according to the present embodiment includes a core 20, a pair of terminal electrodes 50, and a wire 70*a*. The core 20 includes a shaft 21 and a pair of supports 22. The shaft 21 is substantially rectangular parallelepiped shaped. The supports 22 are connected to both ends of the shaft 21. The shaft 21 is supported parallel to a mounting object (circuit board) by the supports 22. The supports 22 are formed integrally with the shaft 21.

The terminal electrodes 50 are formed on the respective supports 22. The wire 70*a* is wound around the shaft 21. The wire 70*a* is similar to the wire 70 according to the above-described first embodiment except for the manner in which the wire 70*a* is wound. The wire 70*a* is wound around the shaft 21 so as to form a single layer on the shaft 21. Both end portions of the wire 70*a* are connected to the respective terminal electrodes 50.

As illustrated in FIG. 8A, the wire 70*a* includes a wound portion 71 wound around the shaft 21, connected portions 72 connected to the terminal electrodes 50, and extending portions 73 that extend between the wound portion 71 and the connected portions 72. The connected portions 72 are connected to the bottom electrode sections 51 of the terminal electrodes 50, the bottom electrode sections 51 being formed on the bottom faces 36 of the supports 22.

The wound portion 71 includes at least one section in which the distance between adjacent turns in the axial direction of the shaft 21 (single turn is a part of the wound portion 71 that extends around the shaft 21 once) is greater than or equal to a predetermined value. The predetermined value is, for example, preferably greater than or equal to about 0.5 times the diameter of the wire 70*a*, and more preferably greater than or equal to about 1 times the diameter of the wire 70*a*. In the present embodiment, the distance La between the turns indicated by an arrow in FIG. 8A is greater than or equal to about 2 times the diameter of the wire 70*a*. Thus, the wound portion 71 of the present embodiment includes at least one section in which the distance between the adjacent turns of the wire 70*a* is greater than or equal to about 2 times the diameter of the wire 70*a*.

A parasitic capacitance is generated between the adjacent turns of the wound portion 71 in the axial direction of the shaft 21. The value of the parasitic capacitance is determined by the distance between the adjacent turns. As the distance between the adjacent turns increases, the value of the parasitic capacitance decreases. In other words, the influence of the parasitic capacitance can be reduced, which leads to a less reduction in the self-resonance frequency (SRF).

The inductor component 10*a* according to the present embodiment has electrical characteristics such that the impedance thereof is greater than or equal to about 500Ω for an input signal having a frequency of about 3.6 GHz. The impedance of the inductor component 10*a* is preferably greater than or equal to about 300Ω at a frequency of about 1.0 GHz and greater than or equal to about 400Ω at a frequency of about 1.5 GHz, more preferably greater than or equal to about 450Ω at a frequency of about 2.0 GHz, and still more preferably greater than or equal to about 500Ω at a frequency of about 4.0 GHz. When the impedance is greater than or equal to a certain value at a specific frequency, noise reduction (choke), resonance (bandpass), and impedance matching can be realized at that frequency.

The inductance of the inductor component 10*a* is preferably about 40 nH to about 70 nH. When the inductance is greater than or equal to about 40 nH, an impedance of greater than or equal to a certain value can be obtained. When the inductance is less than or equal to about 70 nH, a high self-resonance frequency (SRF) can be obtained. In the present embodiment, the inductance of the inductor component 10*a* is, for example, about 60 nH. The above-mentioned inductances are based on an input signal having a frequency of about 10 MHz.

The self-resonance frequency (SRF) of the inductor component 10*a* is preferably greater than or equal to about 3.0 GHz, more preferably greater than or equal to about 3.2 GHz, and still more preferably greater than or equal to about 3.4 GHz. In the present embodiment, the SRF of the inductor component 10*a* is greater than or equal to about 3.6 GHz. Thus, the function of the inductor component can be obtained in a high-frequency band.

The operation of the above-described inductor component 10*a* will now be described.

Figure 10:
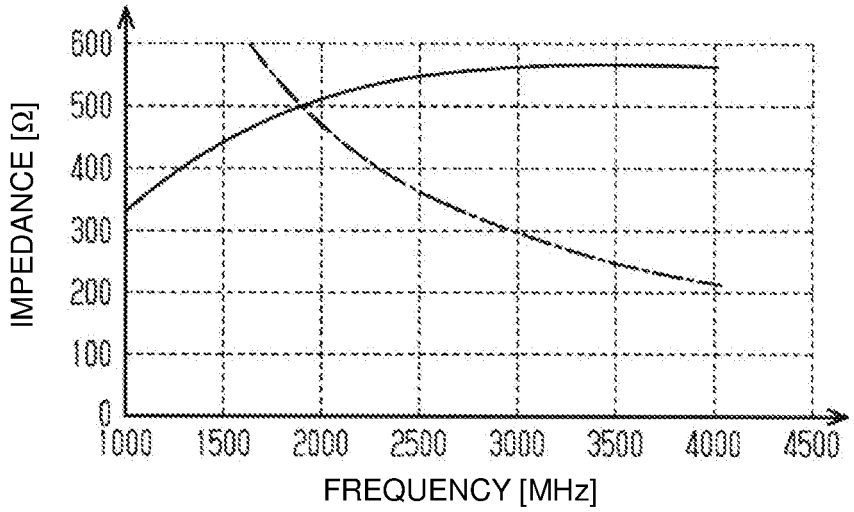
FIG. 10 is a graph showing the frequency-impedance characteristics of the inductor component according to the second embodiment.

FIG. 10 is a graph showing the frequency-impedance characteristics. In FIG. 10, the solid line represents the characteristics of the inductor component 10*a* according to the present embodiment, and the one-dot chain line represents the characteristics of an inductor component according to a comparative example.

The inductor component according to the comparative example includes a core having the same size and shape as the core 20 of the inductor component 10*a* according to the present embodiment, and a wire having the same thickness as the wire 70*a* of the present embodiment, the wire being densely wound around the core. In other words, the wire of the inductor component according to the comparative example includes a wound portion that is wound around the shaft of the core so that adjacent turns are close to each other in the axial direction of the shaft. The inductor component according to the comparative example has an inductance of, for example, about 560 nH, and a self-resonance frequency (SRF) of less than or equal to about 1.5 GHz.

The impedance of the inductor component according to the comparative example decreases as the frequency of the input signal increases. In general, a wire-wound inductor component functions mainly as a capacitive element at a frequency higher than the self-resonance frequency (SRF). This is why the impedance of the inductor component according to the comparative example (SRF: 1.5 GHz) is reduced.

In contrast, the impedance of the inductor component 10*a* according to the present embodiment is greater than or equal to about 400Ω for an input signal having a frequency of greater than or equal to about 1.5 GHz. The impedance is greater than or equal to about 500Ω when the frequency is greater than or equal to about 2.0 GHz. This is consistent with the fact that the self-resonance frequency (SRF) of the inductor component 10*a* according to the present embodiment is about 3.6 GHz.

As described above, the present embodiment has the following effects in addition to the effects of the above-described first embodiment.

(2-1) The inductor component 10*a* includes the core 20, the pair of terminal electrodes 50, and the wire 70*a*. The core 20 includes the shaft 21 and the pair of supports 22. The shaft 21 is substantially rectangular parallelepiped shaped. The supports 22 are connected to both ends of the shaft 21. The shaft 21 is supported parallel to a mounting object (circuit board) by the supports 22. The supports 22 are formed integrally with the shaft 21.

The terminal electrodes 50 are formed on the respective supports 22. The wire 70*a* is wound around the shaft 21. The wire 70*a* is wound around the shaft 21 so as to form, for example, a single layer on the shaft 21. Both end portions of the wire 70*a* are connected to the respective terminal electrodes 50. The inductor component 10*a* is a wire-wound inductor component. The inductor component 10*a* according to the present embodiment has electrical characteristics such that the impedance thereof is greater than or equal to about 500Ω for an input signal having a frequency of about 3.6 GHz. Thus, the inductor component 10*a* having a desired impedance in a high-frequency range can be provided.

Modifications

The above-described embodiments may be modified as appropriate and implemented in the following manners.

In each of the above-described embodiments, the shape of the terminal electrodes may be changed as appropriate.

Although the top edge of each side electrode section 53 is substantially straight in each of the above-described embodiments, the top edge may instead have other shapes as long as the height of the side electrode section 53 gradually increases with increasing distance from the inner face 31 to the end face 32 of the corresponding support 22.

Figure 11:
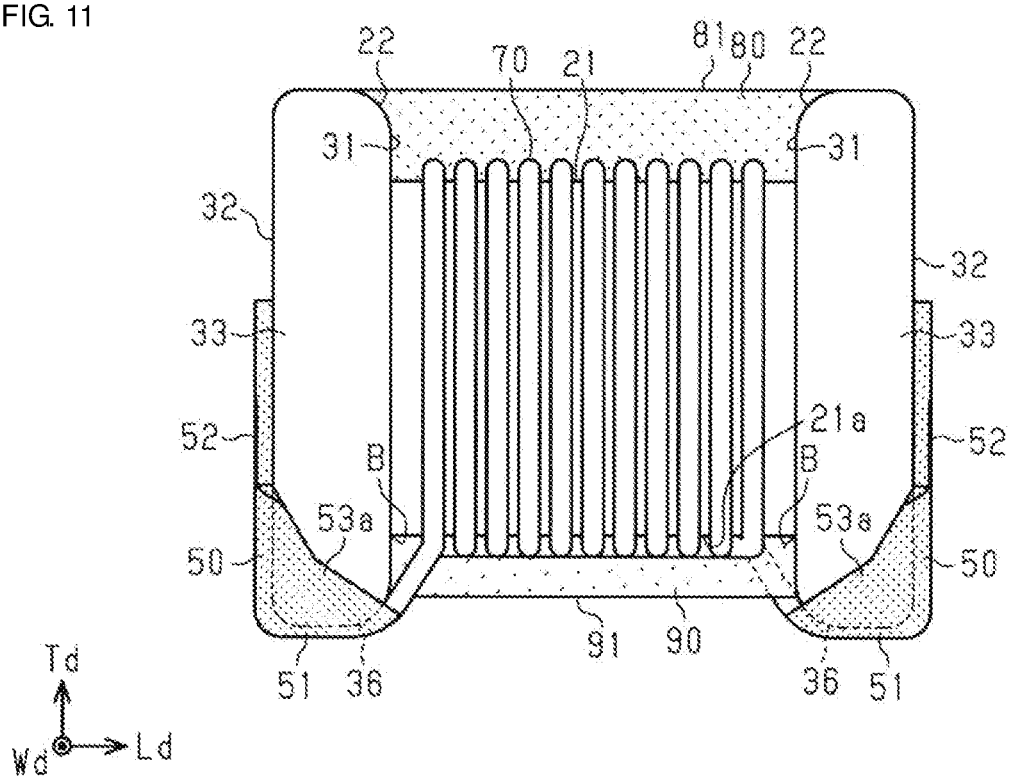
FIG. 11 is a side view of an inductor component according to a modification.

Side electrode sections 53*a* illustrated in FIG. 11 each include two portions having different inclinations. More specifically, the inclination of the portion adjacent to the inner face 31 differs from that of the portion adjacent to the end face 32. In FIG. 11, the portion adjacent to the end face 32 has an inclination greater than that of the portion adjacent to the inner face 31.

Figure 12:
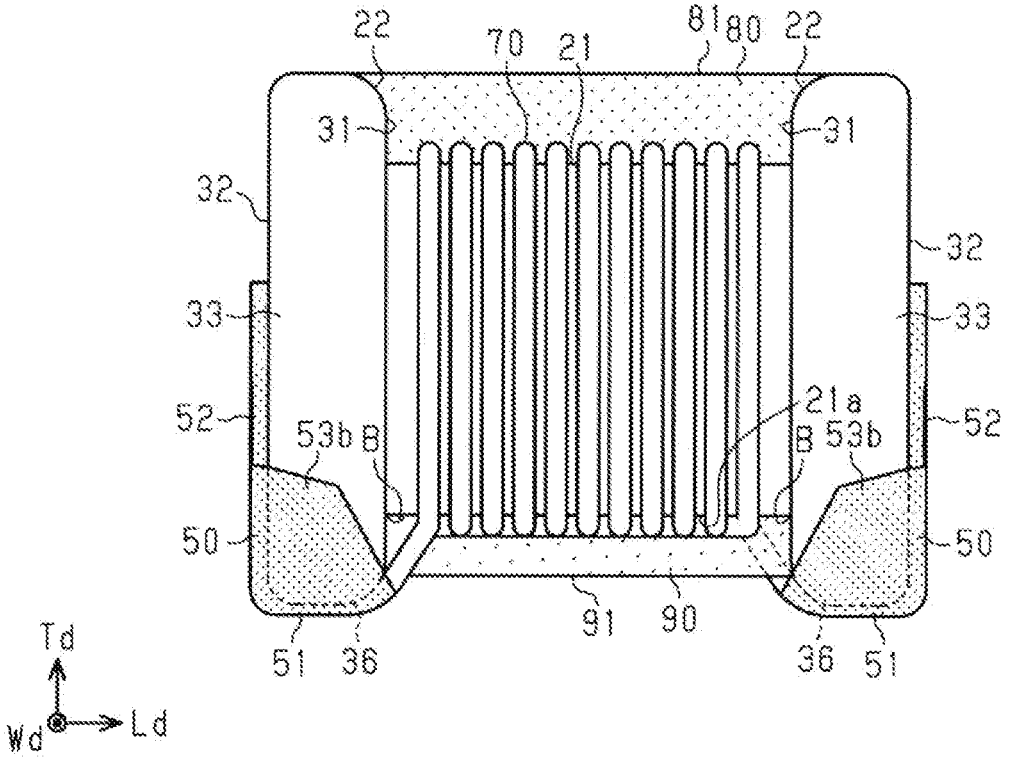
FIG. 12 is a side view of an inductor component according to another modification.

Side electrode sections 53*b* illustrated in FIG. 12 each include a portion adjacent to the inner face 31 and a portion adjacent to the end face 32, the portions having different inclinations. In FIG. 12, the portion adjacent to the inner face 31 has an inclination greater than that of the portion adjacent to the end face 32.

Figure 13:
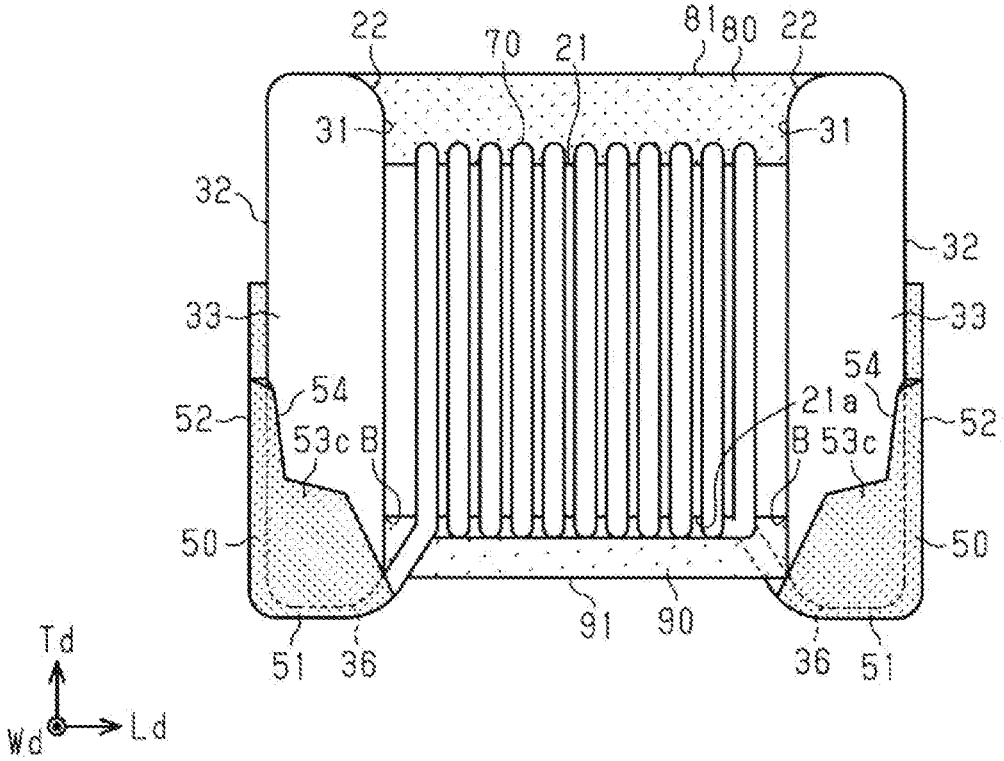
FIG. 13 is a side view of an inductor component according to another modification.

Side electrode sections 53*c* illustrated in FIG. 13 each include two portions having different inclinations. In addition, each terminal electrode 50 includes an inclined electrode section 54 on the ridge at the boundary between the side face 33 and the end face 32. This electrode section 54 may be applied to the terminal electrodes according to the above-described embodiments and modifications.

Although the terminal electrodes 50 on the respective supports 22 have the same shape in the above-described embodiments, the terminal electrodes 50 may instead have different shapes. In addition, although the side electrode sections are shaped so that the heights thereof gradually increase with increasing distances from the inner faces toward the end faces of the supports, the shapes of the side electrode sections may instead be such that the heights thereof are partially reduced. Furthermore, the number of portions of each side electrode section having different inclinations is not particularly limited. Also, each side electrode section may be curved instead of inclined in the region outside the above-described portions. The side electrode sections on both sides of each support may have different shapes. In addition, the side electrode sections on one of the supports and the side electrode sections on the other support may have different inclinations.

Figure 14:
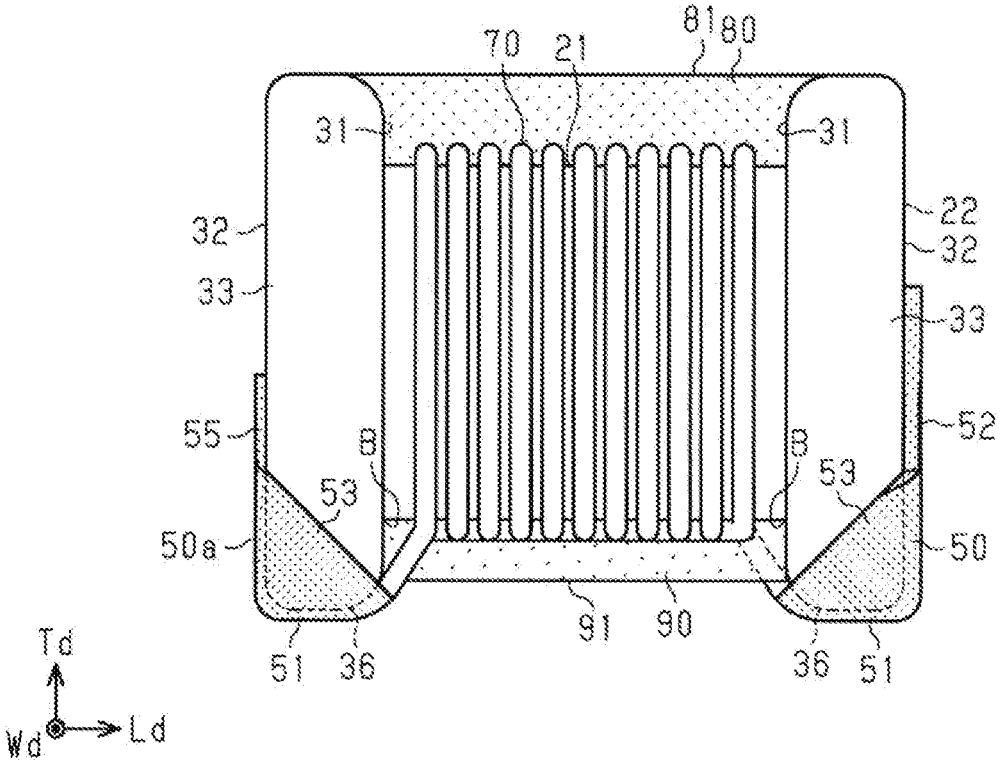
FIG. 14 is a side view of an inductor component according to another modification.

Referring to FIG. 14, the terminal electrode 50 on one of the pair of supports 22 (support 22 on the right side in FIG. 14) is formed such that, as in the above-described embodiment, the end portions 52*b* (see FIG. 1B) of the end electrode section 52 on the end face 32 are higher than the side electrode section 53 on the side face 33. In this case, for example, a terminal electrode 50*a* on the other of the pair of supports 22 (support 22 on the left side in FIG. 14) may be formed such that the height of the end portions of an end electrode section 55 on the end face 32 is substantially equal to that of the side electrode section 53 on the side face 33.

Although the terminal electrodes 50 each include the bottom electrode section 51, the end electrode section 52, and the side electrode sections 53 in the above-described embodiments, the terminal electrodes 50 are not limited to this.

Figure 15:
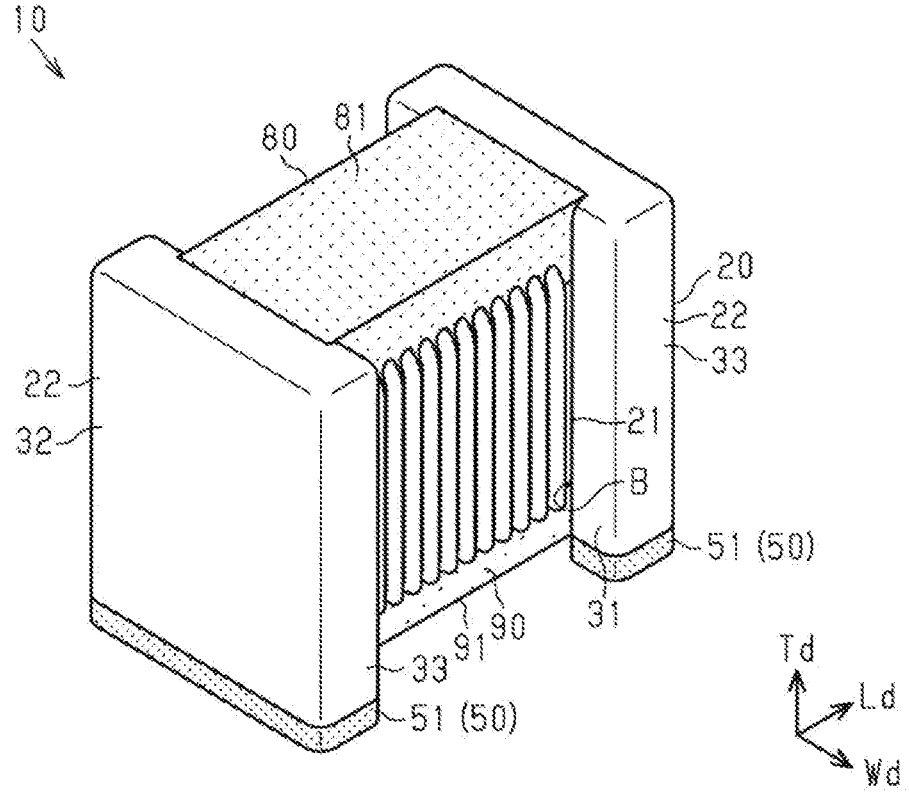
FIG. 15 is a perspective view of an inductor component according to another modification.

FIG. 15 illustrates terminal electrodes 50 which each include only the bottom electrode section 51. Also in this structure, the terminal electrodes 50 (bottom electrode sections 51) are formed in regions outside the boundary portions B. Therefore, an effect similar to the effect described in (1-2) in the first embodiment can be obtained.

The boundary portions B may be covered by the terminal electrodes. Also in this structure, when the bottom cover member 90 is arranged to cover the boundary portions B together with the terminal electrodes, an effect similar to the effect described in (1-1) in the first embodiment can be obtained.

In the first embodiment, the shape of the top cover member 80 may be changed as appropriate.

Figure 16:
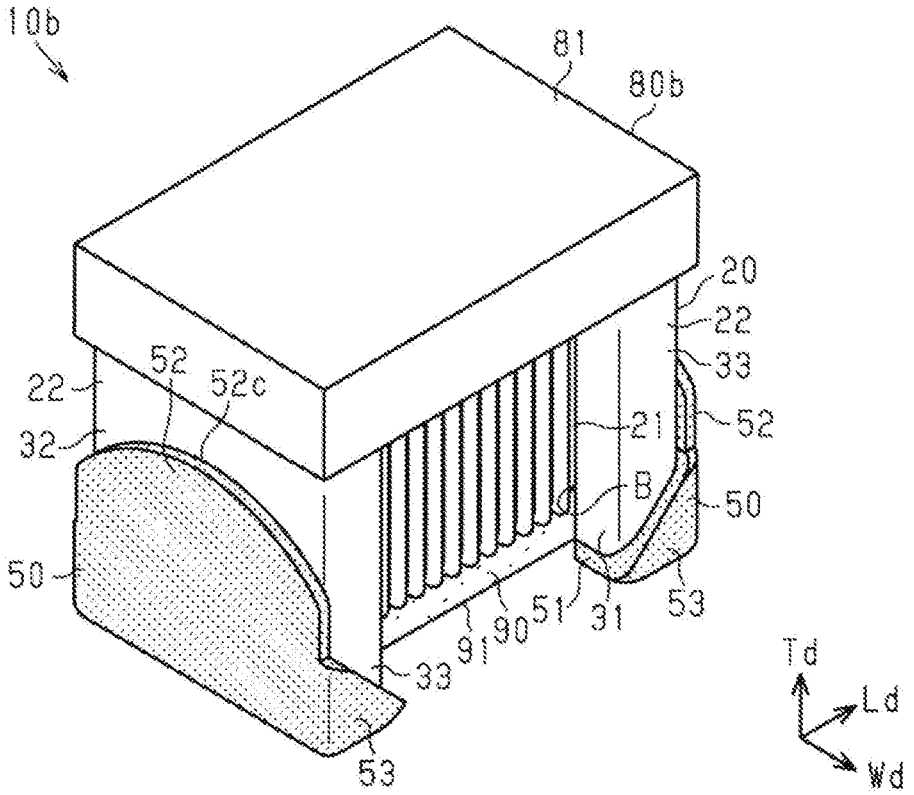
FIG. 16 is a perspective view of an inductor component according to another modification.

An inductor component 10*b* illustrated in FIG. 16 includes a top cover member 80*b* disposed between supports 22. The cover member 80*b* is formed so as to cover the wire 70 (wound portion 71) wound around the shaft 21. The cover member 80*b* has a substantially flat top face 81. The cover member 80*b* covers the top faces 35 of the supports 22. Thus, the top faces 35 of the supports 22 are covered. In this case, the length and width dimensions of the cover member 80*b* at the top of the inductor component 10*b* are greater than the length and width dimensions of the core 20. This structure may also be applied to the second embodiment. Alternatively, the top cover member 80 may be omitted.

In the above-described embodiments, the two boundary portions B at the respective locations are covered by a single bottom cover member 90. However, two bottom cover members 90 may instead be arranged to cover the two boundary portions B individually. In this case, the two bottom cover members 90 are apart from each other, and therefore the area in which the wire 70 is covered can be reduced. Thus, degradation of characteristics can be further suppressed.

In the above-described embodiments, the bottom cover member 90 is arranged so as not to project beyond the supports 22. However, the bottom cover member 90 may instead be arranged so as to project beyond the supports 22.

In the above-described embodiments, the bottom cover member 90 is made of a magnetic resin (magnetic material). However, the bottom cover member 90 may instead be made of a non-magnetic material. When the bottom cover member 90 is made of a non-magnetic material, degradation of characteristics, such as an increase in stray capacitance due to $\varepsilon$ characteristics and a reduction in Q factor due to tan $\delta$, can be further suppressed.

In the above-described embodiments, the height dimension T1 of the inductor component 10 is greater than the width dimension W1 of the inductor component 10. However, the width dimension W1 and the height dimension T1 of the inductor component may instead be equal.

The above-described embodiments and modifications may be combined as appropriate.

APPENDIX 1

The inductor component according to any one of the claims, wherein the end portion of the end electrode section adjacent to the side face is higher than an end portion of the side electrode section adjacent to the end face. With this structure, the end electrode section is high, and the surface area thereof is increased accordingly. When the surface area is increased, each terminal electrode can be strongly connected to the circuit board. In other words, the fixing force between the inductor component and the circuit board can be increased. Accordingly, the inductor component that is reduced in size can be sufficiently strongly fixed to the circuit board, which is a mounting object. Thus, a reduction in the fixing force can be suppressed.

APPENDIX 2

The inductor component according to any one of the claims or Appendix 1, wherein each support includes a first ridge that is rounded at a boundary between an inner face and the bottom face of the support, and a second ridge that is rounded at a boundary between the bottom face and the end face, the inner faces of the supports facing each othera A radius of curvature of the second ridge is greater than or equal to about 20 μm, and a radius of curvature of the first ridge is greater than the radius of curvature of the second ridge.

With this structure, the wire is wound around the shaft, and the end portions thereof are connected to the bottom electrode sections of the terminal electrodes. Thus, the wire extends from the bottom faces of supports to the shaft. Since the first ridge of each support at the boundary between the bottom face and the inner face has a large radius of curvature, the wire is curved with a large radius of curvature at the first ridge. Thus, the occurrence of breakage of the wire whose diameter is less than or equal to a certain diameter can be reduced.

APPENDIX 3

The inductor component according to Appendix 2, wherein the radius of curvature of the first ridge is greater than the radius of curvature of the second ridge by an amount greater than or equal to about 9% of the radius of curvature of the second ridge. It has been confirmed that breakage of the wire does not occur in a plurality of inductor components having such a structure.

APPENDIX 4

The inductor component according to Appendix 2 or 3, wherein the inner face of each support is vertical between the first ridge and the shaft. This structure provides a sufficient space for winding the wire in the region between the supports.

APPENDIX 5

The inductor component according to any one of Appendixes 2 to 4, wherein each support includes a third ridge that is rounded at a boundary between a top face and the inner face, and a fourth ridge that is rounded at a boundary between the top face and the end face. Also, 1 radius of curvature of the third ridge is greater than a radius of curvature of the fourth ridge. With this structure, the core can be held in a short time in a process of, for example, forming the terminal electrodes, and the processing step can thus be facilitated.

APPENDIX 6

The inductor component according to any one of the claims or any one of Appendixes 1 to 5, wherein each terminal electrode includes an underlying layer on a surface of the core and a plating layer on a surface of the underlying layer. Also, a maximum thickness of the underlying layer on the end face of the corresponding support is greater than a maximum thickness of the underlying layer on the bottom face of the corresponding support. With this structure, the thickness of the end electrode section can be increased due to the thick underlying layer, and an end electrode section having a large area can be formed.

APPENDIX 7

The inductor component according to any one of the claims or any one of Appendixes 1 to 6, wherein the terminal electrodes are not formed on top faces of the supports. With this structure, the center of gravity of the inductor component is low due to the thick end electrode section. This enables the inductor component to be easily placed in a stable position in the mounting process.

APPENDIX 8

The inductor component according to Appendix 7, wherein each support has a ridge that is rounded at a boundary between the bottom face and the end face, and a radius of curvature of the ridge is greater than or equal to about 20 μm. If the radius of curvature of the ridge is small, the underlying layer is reduced in thickness and easily breaks in the region between the underlying layer on the bottom face and the underlying layer on the end face. When the radius of curvature of the ridge is greater than or equal to a predetermined value, the underlying layer has a sufficient thickness and does not easily break in the region between the underlying layer on the bottom face and the underlying layer on the end face.

APPENDIX 9

The inductor component according to any one of the claims or any one of Appendixes 1 to 8, wherein the terminal electrode on a first one of the supports and the terminal electrode on a second one of the supports have different shapes. With this structure, the design flexibility of the terminal electrodes of the inductor component and the land pattern on the mounting board can be increased.

APPENDIX 10

The inductor component according to any one of the claims or any one of Appendixes 1 to 9, wherein an end portion of the side electrode section adjacent to the end face extends to a position higher than a bottom face of the shaft. With this structure, the end electrode section connected to the side electrode section is higher than that in an ordinary terminal electrode. Therefore, the height of the solder fillet can be increased.

APPENDIX 11

The inductor component according to any one of the claims or any one of Appendixes 1 to 10, wherein the side electrode section includes two portions having different inclinations, and an inclination of one of the two portions that is adjacent to the end face is greater than an inclination of other of the two portions that is adjacent to a corresponding one of the inner faces of the supports that face each other. With this structure, the design flexibility of the terminal electrodes of the inductor component and the land pattern on the mounting board can be increased.

APPENDIX 12

The inductor component according to any one of the claims or any one of Appendixes 1 to 10, wherein the side electrode section includes two portions having different inclinations, and an inclination one of the two portions that is adjacent to a corresponding one of the inner surfaces of the supports that face each other is greater than an inclination of other of the two portions that is adjacent to the end face. With this structure, the design flexibility of the terminal electrodes of the inductor component and the land pattern on the mounting board can be increased.

APPENDIX 13

The inductor component according to any one of the claims or any one of Appendixes 1 to 12, wherein each terminal electrode includes an electrode section disposed between the side electrode section and the end electrode section on a ridge at a boundary between the side face and the end face. Also, the electrode section has an inclination greater than an inclination of the side electrode section. With this structure, the design flexibility of the terminal electrodes of the inductor component and the land pattern on the mounting board can be increased.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a core including a substantially column-shaped shaft and a pair of supports provided at both ends of the shaft;

terminal electrodes provided on the supports;

a wire wound around the shaft and including end portions connected to the terminal electrodes, the wire being exposed at a side of the shaft; and a bottom cover member that is located on a bottom side of the inductor component and covers a boundary portion between the shaft and one of the supports at a bottom of the shaft, wherein each of the supports includes an end face, configured such that the end faces of the supports face away from each other and away from the shaft in a length direction upon which the wire is wound around the shaft, each terminal electrode is located on the bottom side of the inductor component, and the each terminal electrode extends from the bottom side of the inductor component higher in a height direction than the bottom cover member and includes an end electrode section on the end face of a corresponding one of the supports, an entire top edge of the end electrode section is substantially upwardly convex and arc-shaped, and each terminal electrode further includes side electrode sections respectively on opposite side surfaces of the corresponding one of the supports and respectively spaced from an entirety of the top edge of the end electrode section along the opposite side surfaces, such that a width between outer oppositely facing surfaces of the side electrode sections is greater than a width of the end electrode section.

2. The inductor component according to claim 1, wherein the terminal electrode is formed outside the boundary portion, and the bottom cover member directly covers the boundary portion.

3. The inductor component according to claim 1, wherein the bottom cover member is made of a magnetic material.

4. The inductor component according to claim 1, wherein the bottom cover member does not project downward beyond the supports.

5. The inductor component according to claim 1, wherein a width dimension of the shaft is less than a width dimension of the supports.

6. The inductor component according to claim 1, further comprising:

a top cover member that is disposed at least between the supports and covers a top face of the shaft.

7. The inductor component according to claim 6, wherein the bottom cover member and the top cover member are apart from each other.

8. The inductor component according to claim 1, wherein the wire includes a wound portion wound around the shaft, connected portions connected to the terminal electrodes, and extending portions that extend between the wound portion and the connected portions, and the bottom cover member covers one of the extending portions.

9. The inductor component according to claim 1, wherein each terminal electrode includes a bottom electrode section on a bottom face of a corresponding one of the supports, and the end electrode section is higher at a central portion of the end electrode section in a width direction of the end face than at an end portion of the end electrode section in the width direction of the end face.

10. The inductor component according to claim 9, wherein a ratio of a height of the central portion of the end electrode section in the width direction of the end face to a height of the end portion of the end electrode section in the width direction of the end face is about 1.1 or greater.

11. The inductor component according to claim 9, wherein a ratio of a height of the central portion of the end electrode section in the width direction of the end face to a height of the end portion of the end electrode section in the width direction of the end face is about 1.2 or greater.

12. The inductor component according to claim 9, wherein a ratio of a height of the central portion of the end electrode section in the width direction of the end face to a height of the end portion of the end electrode section in the width direction of the end face is about 1.3 or greater.

13. The inductor component according to claim 9, wherein each terminal electrode further includes a side electrode section on a side face of the corresponding one of the supports, and heights of the side electrode sections of the terminal electrodes gradually increase with increasing distances from opposing faces of the supports toward the end faces of the supports.

14. The inductor component according to claim 1, wherein part of the inductor component including the core and the terminal electrodes has a length dimension of less than or equal to about 1.0 mm, a width dimension of less than or equal to about 0.6 mm, and a height dimension of less than or equal to about 0.8 mm.

15. The inductor component according to claim 14, wherein the height dimension is greater than the width dimension.

16. The inductor component according to claim 2, wherein the bottom cover member is made of a magnetic material.

17. The inductor component according to claim 2, wherein the bottom cover member does not project downward beyond the supports.

18. The inductor component according to claim 2, wherein a width dimension of the shaft is less than a width dimension of the supports.

19. The inductor component according to claim 2, further comprising:

a top cover member that is disposed at least between the supports and covers a top face of the shaft.

20. An inductor component comprising:

a core including a substantially column-shaped shaft and a pair of supports provided at both ends of the shaft;

terminal electrodes provided on the supports;

a wire wound around the shaft and including end portions connected to the terminal electrodes, the wire being exposed at a side of the shaft; and a bottom cover member that covers a boundary portion between the shaft and one of the supports at a bottom of the shaft, wherein each of the supports includes an end face, configured such that the end faces of the supports face away from each other and away from the shaft in a length direction upon which the wire is wound around the shaft, each terminal electrode includes an end electrode section on the end face of a corresponding one of the supports and side electrode sections respectively on opposite side surfaces of the corresponding one of the supports and respectively spaced from an entirety of the top edge of the end electrode section along the opposite side surfaces, such that a width between outer oppositely facing surfaces of the side electrode sections is greater than a width of the end electrode section, and an entire top edge of the end electrode section is substantially upwardly convex and arc-shaped.

* * * * *